US006131748A

United States Patent [19]

Kawasaki et al.

[11] Patent Number: 6,131,748

[45] **Date of Patent: *Oct. 17, 2000**

[54] ARTICLE DISPLAY DEVICE

[75] Inventors: Junzaburo Kawasaki, c/o Kawajun Co., Ltd. 30-1, Nihonbashihamacho 2-chome, chuo-ku, Tokyo 103, Japan; Hideaki Kawamura; Akihiko Endo, both of Tokyo, Japan

[73] Assignees: Kawajun Co., Ltd.; Junzaburo Kawasaki, both of Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/068,105

[22] PCT Filed: Nov. 1, 1996

[86] PCT No.: PCT/JP96/03224

§ 371 Date: May 4, 1998

§ 102(e) Date: May 4, 1998

[87] PCT Pub. No.: WO97/17872

PCT Pub. Date: May 22, 1997

[30] Foreign Application Priority Data

Nov. 13, 1995 [JP] Japan ..... 7-318604
Mar. 8, 1996 [JP] Japan ..... 8-051648

[51] Int. Cl.[7] ..... B42F 13/12; A47F 1/12

[52] U.S. Cl. ..... 211/54.1; 211/57.1; 211/59.3

[58] Field of Search ..... 211/54.1, 57.1, 211/59.1, 59.3, 51, 43; 312/71

[56] References Cited

U.S. PATENT DOCUMENTS

| | | | |
|---|---|---|---|
| 1,702,987 | 2/1929 | Wilson | 211/73 X |
| 4,475,658 | 10/1984 | Roberts | 211/54.1 |
| 4,869,376 | 9/1989 | Valiulis et al. | 211/54.1 X |
| 5,325,616 | 7/1994 | Valiulis | 211/54.1 X |
| 5,485,930 | 1/1996 | Rushing | 211/59.1 |

*Primary Examiner*—Daniel P. Stodola
*Assistant Examiner*—Erica B. Harris
*Attorney, Agent, or Firm*—Oblon, Spivak, McClelland, Maier & Neustadt, P.C.

[57] ABSTRACT

An article display device including an engaging piece (4), an article display bar (6), a supporting bar(7), an urging body (12) and a manipulation bar (17). The engaging piece (4) is configured to be attached to a bar member of an article display rack. An article display bar (6) on which at least one article is supported has a front end and a rear end which is connected to the engaging piece (4). The supporting bar (7) extends along the article display bar and is positioned above the same. The supporting bar (7) is connected to the engaging piece or the rear end of the article display bar. The urging body (12) is slidably supported by the supporting bar. The at least one article is moved along the article display bar toward the front end of the article display bar by the urging body. The manipulation bar (17) has a rear portion attached to the urging body and extends along the supporting bar.

1 Claim, 26 Drawing Sheets

ARTICLE DISPLAY DEVICE

TECHNICAL FIELD

The present invention relates to an article display device which is suitable for displaying a large number of articles in a suspended state such that the articles are always aligned orderly at the forefront on article display bars of an article display rack in a supermarket, a drugstore, and so on.

BACKGROUND ART

Conventionally, an article display device for use in an article display rack in a supermarket, a drugstore, or the like is composed of an engaging piece, which may be removably or unremovably attached to a bar member of the article display rack; an article display bar having the rear end secured to the engaging piece and the front end inclined upwardly; and a supporting bar positioned above the article display bar, to which a display plate is attached at the front end thereof and which is linked to the rear end of the article display bar.

However, with the article display device, since articles suspended on the article display bar are removed from the forefront, remaining articles are positioned in a rear portion of the article display rack when few articles are left suspended. Since the articles left in the rear portion of the rack are difficult to view, they must be moved to the front. There is, however, a disadvantage in that work required therefor is troublesome and time-consuming. In addition, for articles displayed at narrow intervals, when they are drawn to the front, adjacent articles are also moved together to result in an disordered display state, thus causing a disadvantage of requiring a rearranging work therefor.

Thus, in view of the disadvantages of the conventional article display device as mentioned above, it is an object of the present invention to provide an article display device which allows for readily and easy work to draw articles suspended on an article display bar to the front to always ensure a highly efficient article display state.

DISCLOSURE OF THE INVENTION

The present invention provide an article display device characterized by comprising an engaging piece removably or unremovably attached to a bar member of an article display rack, an article display bar having a rear end fixed to the engaging piece, a supporting bar positioned above the article display bar and linked to the engaging piece or to the rear end of the article display bar, an urging body slidably attached to the supporting bar for urging articles supported by the article display bar to the front, and means for sliding the urging body.

The present invention also provides the article display device which comprises a resilient body for always urging the urging body to the rear.

The present invention also provides the article display device which comprises an article arrangement correcting member attached to the front end of the supporting bar and abutting an article at the forefront supported by the article display bar.

The present invention further provides an article display device characterized by comprising an engaging piece removably or unremovably attached to a bar member of an article display rack, an article display bar having a non-circular cross-section and a rear end fixed to the engaging piece, an urging body non-rotatably and slidably attached to the article display bar and capable of urging articles supported by the article display bar to the front, and a supporting bar having a rear end fixed to the urging body and a front end to which a display plate is attached, and positioned above the article display bar.

The present invention further provides an article display device characterized by comprising an engaging piece removably or unremovably attached to a bar member of an article display rack, an article display bar having a rear end fixed to the engaging piece, a supporting bar positioned above the article display bar, integrally formed with the engaging piece or the rear end of the article display bar, an urging body slidably attached to the article display bar and capable of urging articles supported by the article display bar, and a pushing mechanism for always pushing the urging body to the front.

It is therefore possible to readily move articles left in the rear to the front in a short time, thus significantly reducing a time required for the conventionally performed article move-front work. This allows articles to be efficiently displayed and can contribute to an increase in sales. Also, since the article display device is simple in structure, it can be readily manufactured and can be easily used by anyone.

BEST MODE FOR CARRYING OUT THE INVENTION

Figure 1:
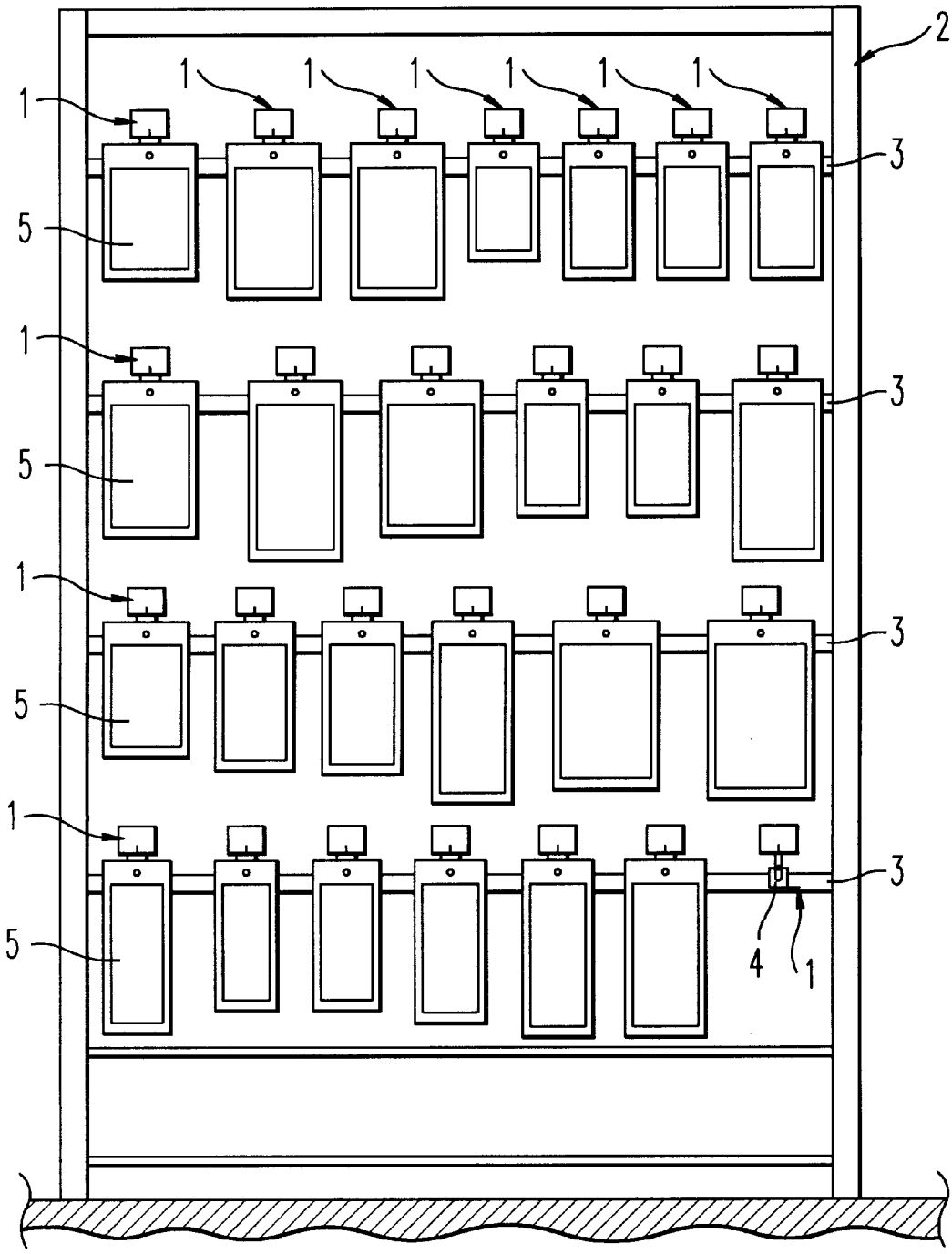
FIG. 1 illustrates a front view of a first embodiment of the present invention in a used state.
Figure 2:
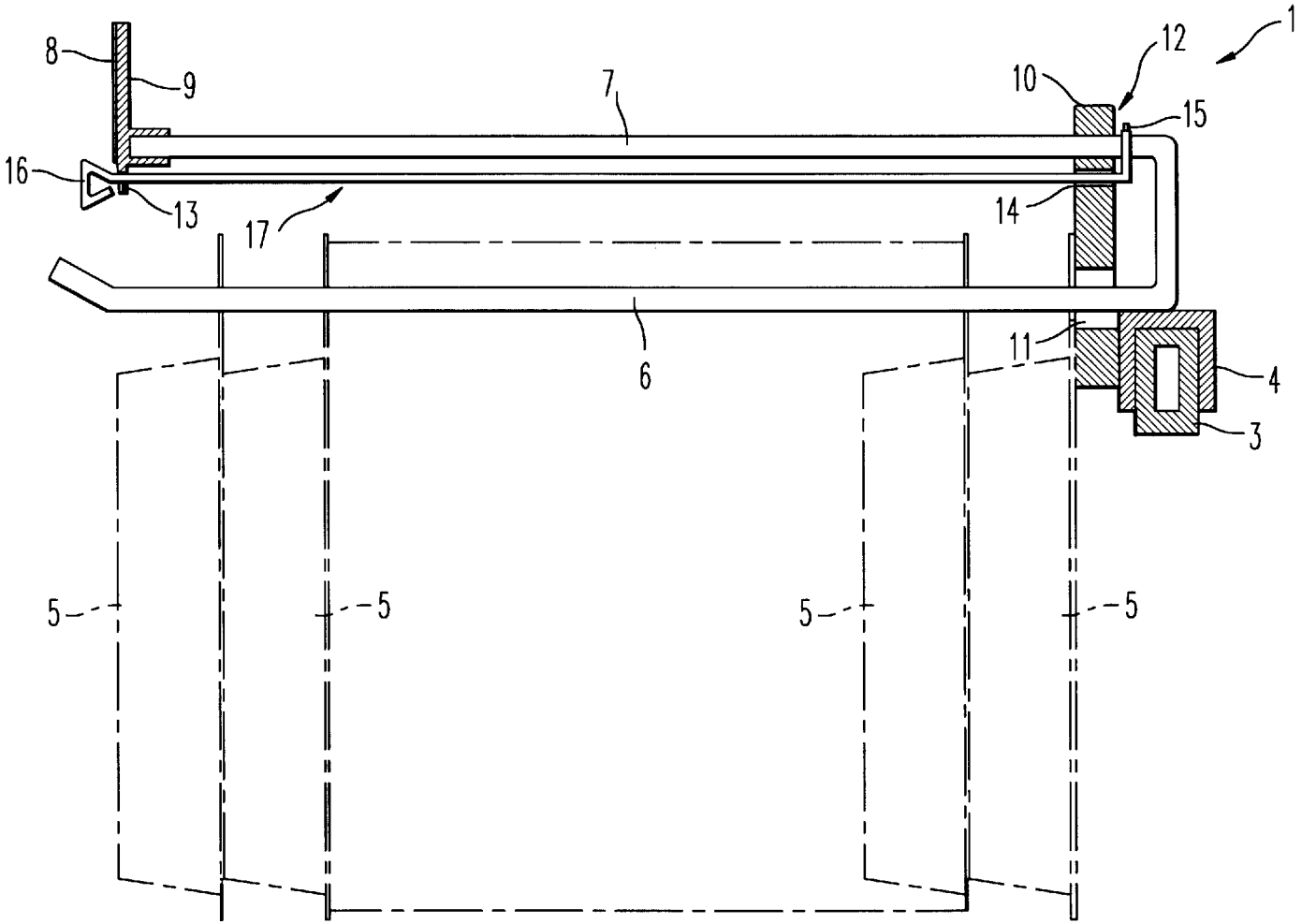
FIG. 2 illustrates a cross-sectional view of a main portion of the first embodiment of the present invention in a used state when viewed from a side.

The present invention will hereinafter be described in detail in connection with embodiments illustrated in the drawings.

In a first embodiment of the present invention in FIGS. 1–6, 1 designates an article display device of the present invention which is removably attached to a bar member 3 of an article display rack 2. This article display device 1 comprises a channel-like engaging piece 4 removably attached to the bar member 3; an article display bar 6 having the rear end secured to the engaging piece 4 by welding or the like and the front end inclined upwardly for suspending a large number of packaged articles 5; a supporting bar 7, positioned above the article display bar 6, having the rear end integrally formed with the engaging piece 4 or the rear end of the article display bar 6, in this embodiment, linked with the article display bar 6; a display plate 9 fitted on a front end portion of the supporting bar 7, on which a display card 8 can be securely adhered; an urging body 12, formed with an inserting hole 10 into which the supporting bar 7 is inserted, slidably suspended on the supporting bar 7 to have the ability of urging the articles 5 suspended on article display bar 6 , and having an elongated article display bar inserting hole 11; and means for sliding, a throughhole 13, formed through the display plate 9 and the urging body 12, in this embodiment, a manipulation bar 17 slidably extending through a throughhole 14 formed through the urging body 12, and having a stopping piece 15 formed at the rear end thereof for stopping the urging body 12 and a handle 16 formed at the front end thereof.

Figure 3:
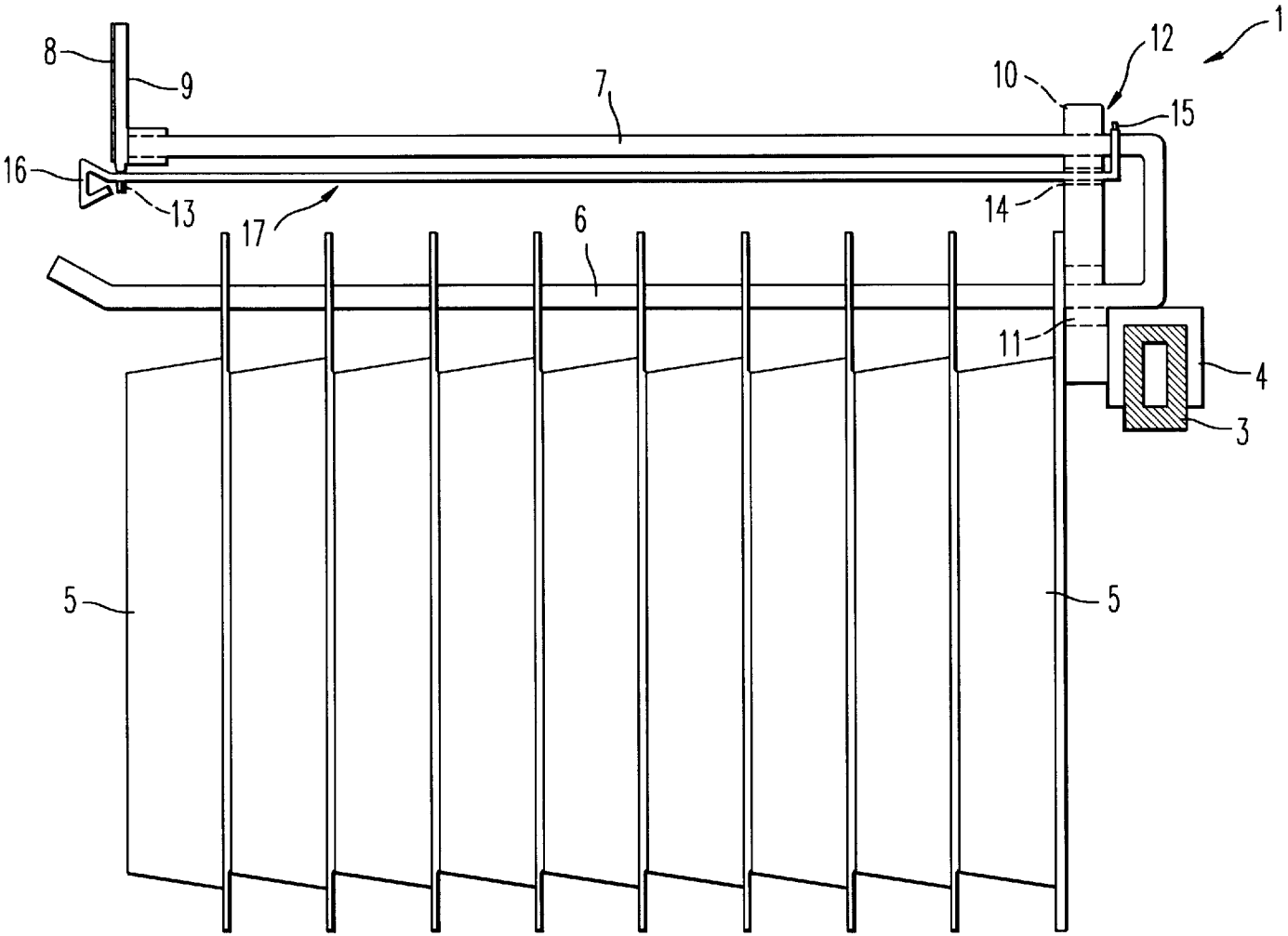
FIG. 3 illustrates a side view of the first embodiment of the present invention in a used state.
Figure 4:
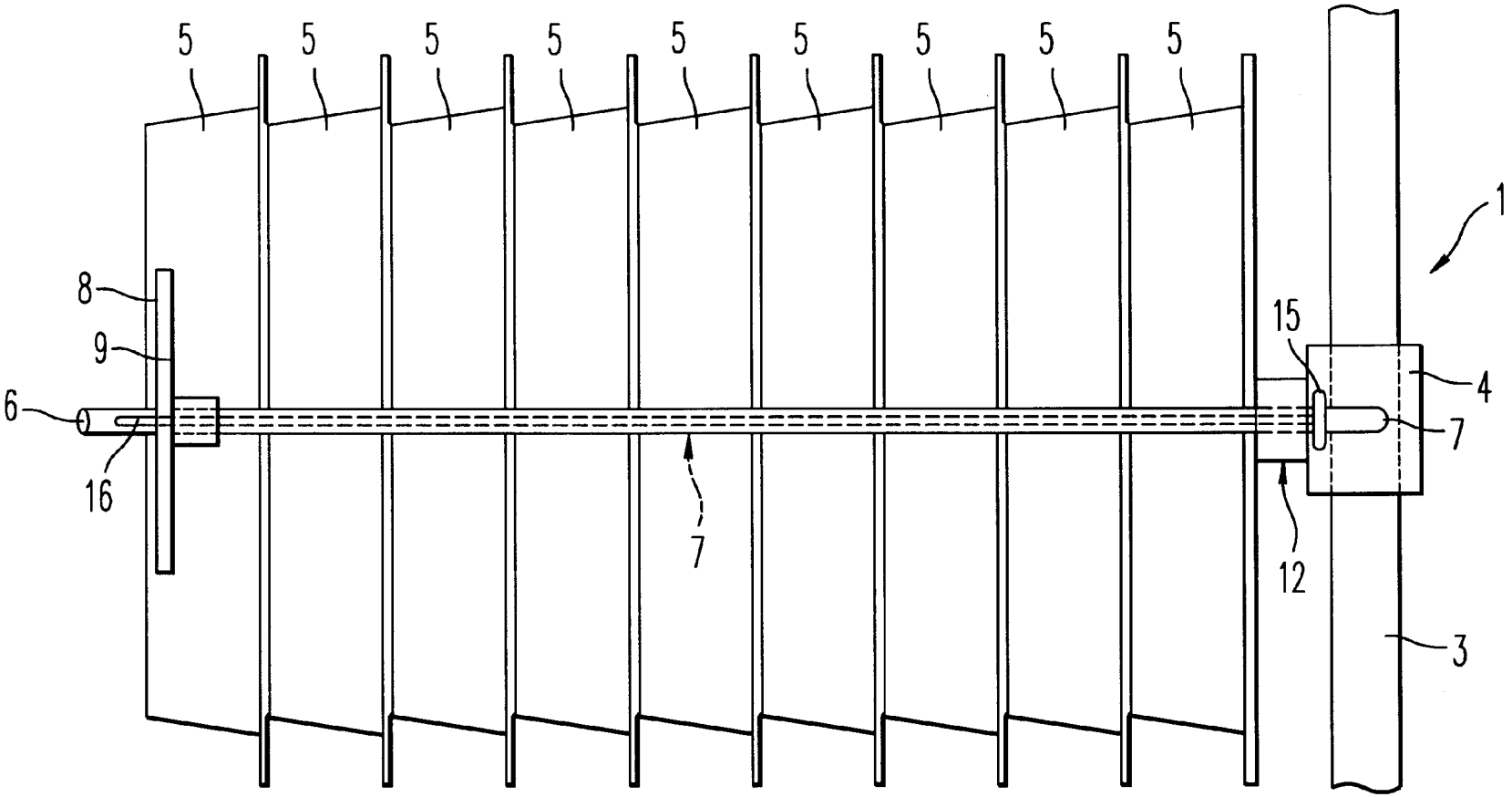
FIG. 4 illustrates a plan view of the first embodiment of the present invention in a used state.
Figure 5:
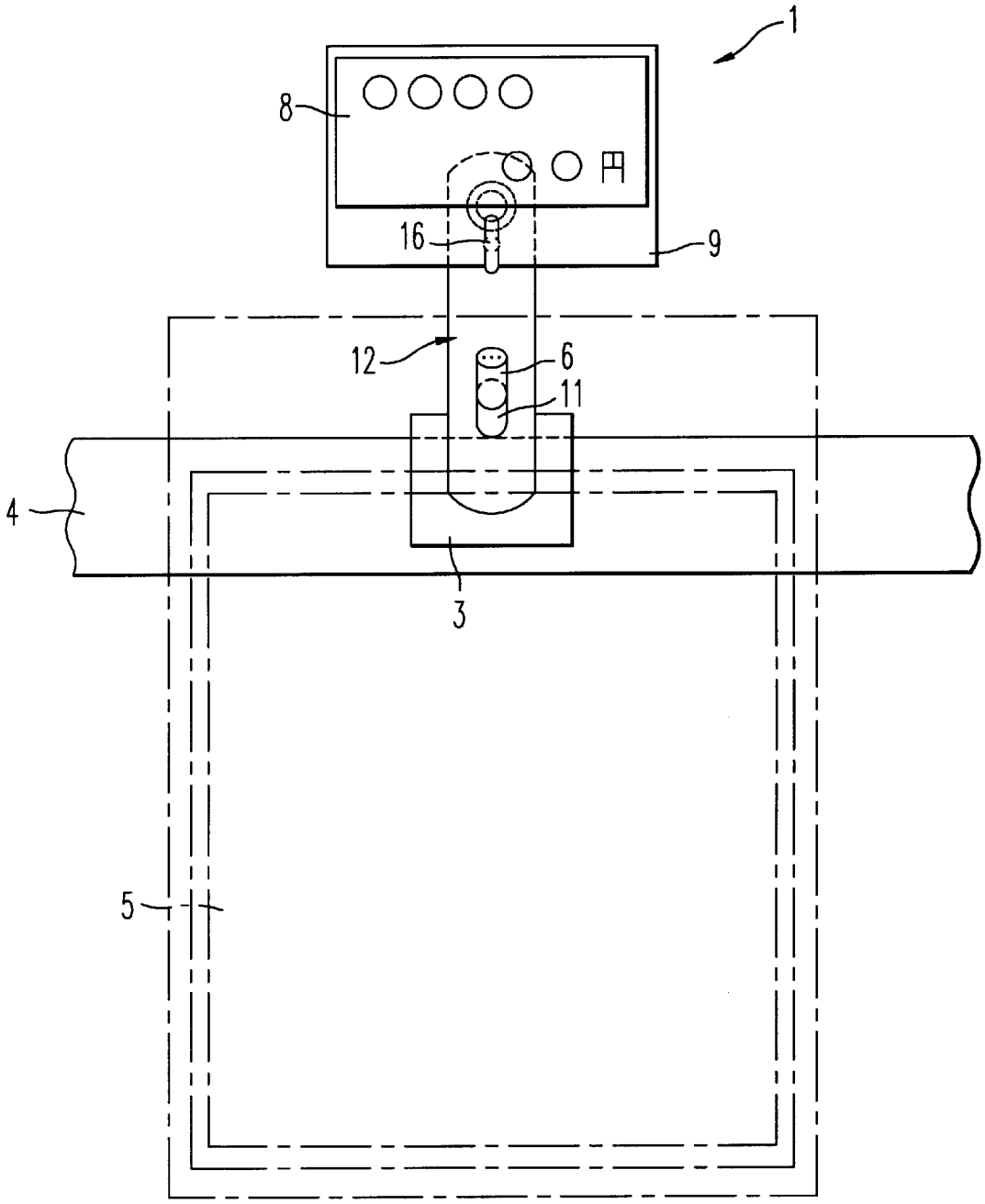
FIG. 5 illustrates a front view of the first embodiment of the present invention in a used state.

With the article display device 1 structured as mentioned above, the packaged articles 5 are loaded onto the article display bar 6 in a suspended state from the front end thereof and pushed toward the rear as illustrated in FIG. 3, whereby the urging body 12 is slid on the supporting bar 7 and positioned in the rear.

Figure 6:
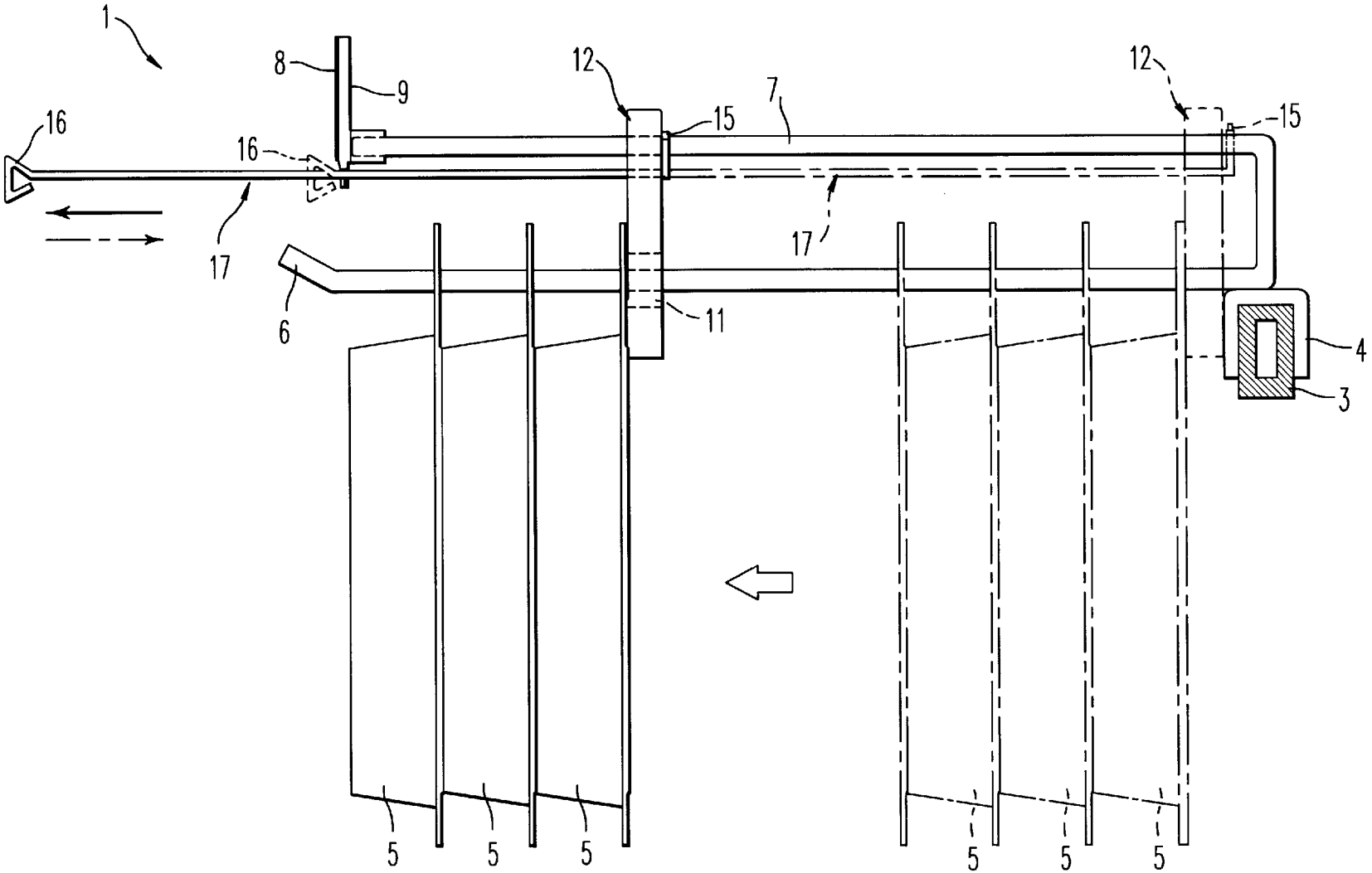
FIG. 6 illustrates an explanatory diagram for a state in which a manipulation bar is actuated in the first embodiment of the present invention.

When the articles are sold so that no articles 5 are found at the forefront of the article display bar 6, the handle 16 of the manipulation bar 17 is held and pulled out, as illustrated in FIG. 6, to slide the urging body 12 to the front such that the articles 5 are extruded to the front.

When the articles 5 left in front are positioned in a front end portion of the article display bar 6, the manipulation bar 17 is pushed as indicated by a virtual line.

Next, different embodiments of the present invention illustrated in FIGS. 7–40 will be described. For describing these different embodiments of the present invention, the same constituents as those in the foregoing first embodiment of the present invention are designated the same reference numerals, and repetitive explanation is omitted.

Figure 7:
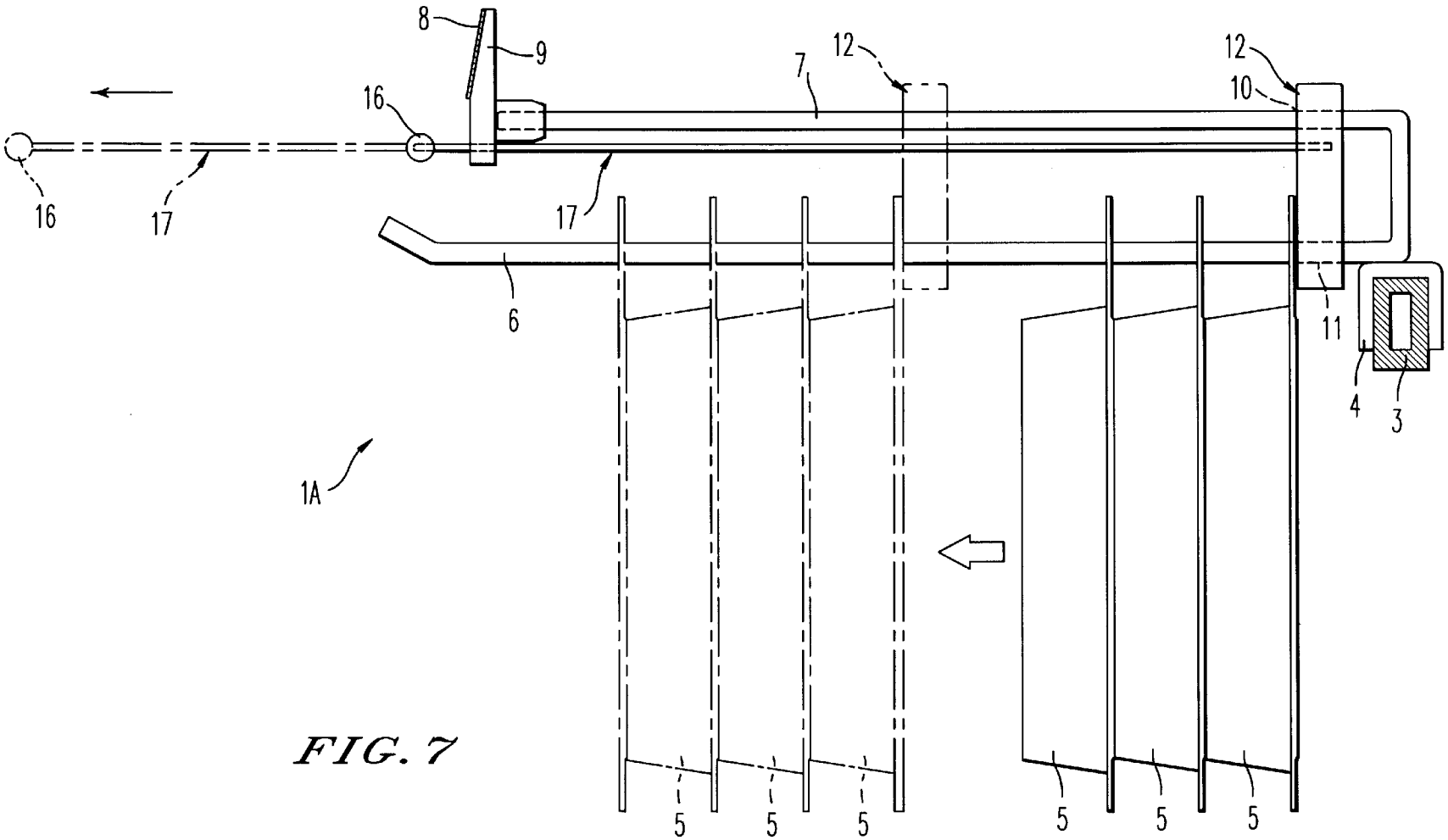
FIG. 7 illustrates a side view of a second embodiment of the present invention in a used state.
Figure 8:
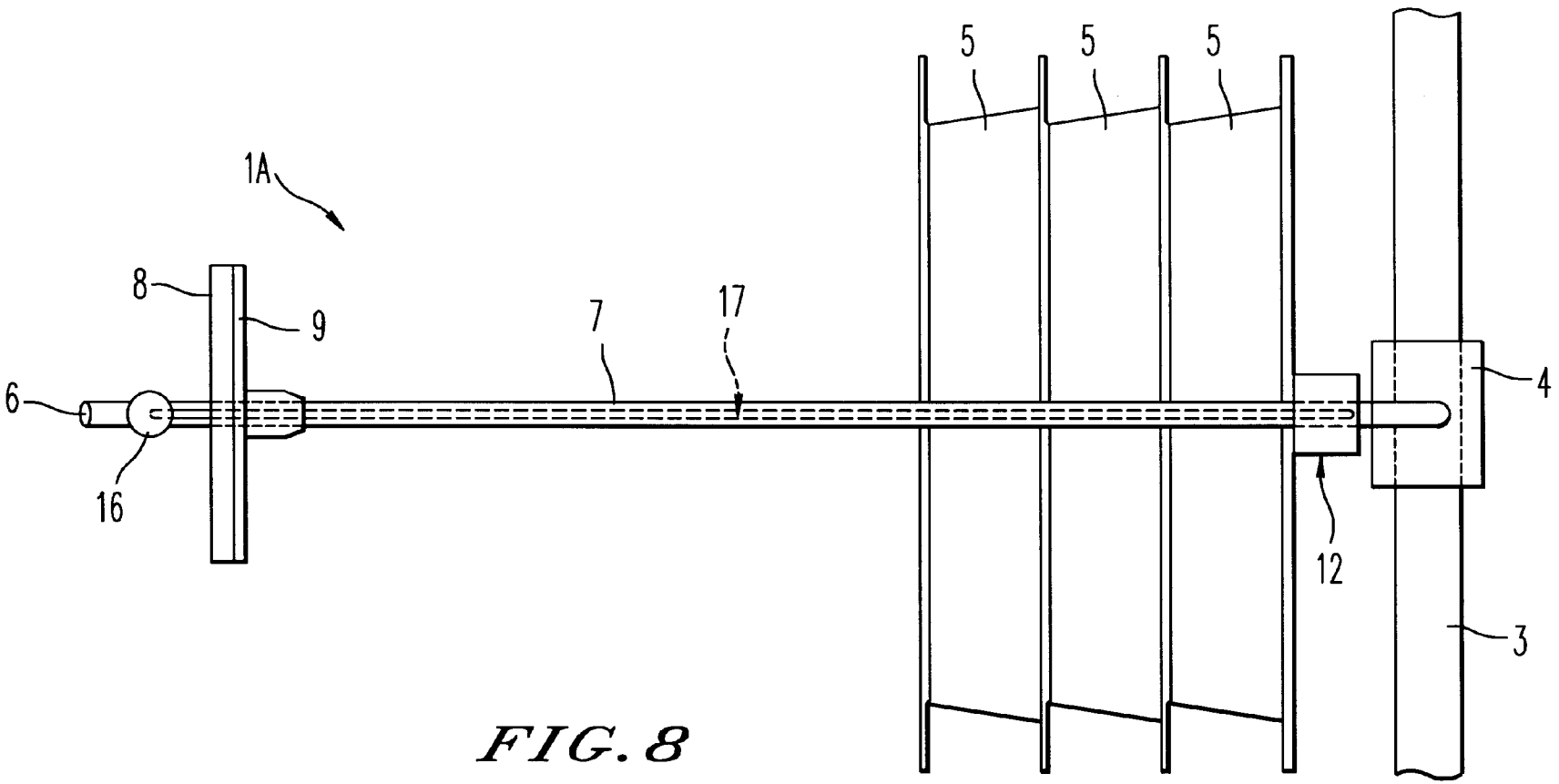
FIG. 8 illustrates a plan view of the second embodiment of the present invention in a used state.

A second embodiment of the present invention in FIGS. 7 and 8 differs from the foregoing first embodiment of the present invention mainly in that the rear end of the manipulation bar 17 is secured to the urging body 12, and an article display device 1A thus constructed also has similar meritorious effects to the foregoing first embodiment of the present invention.

Figure 9:
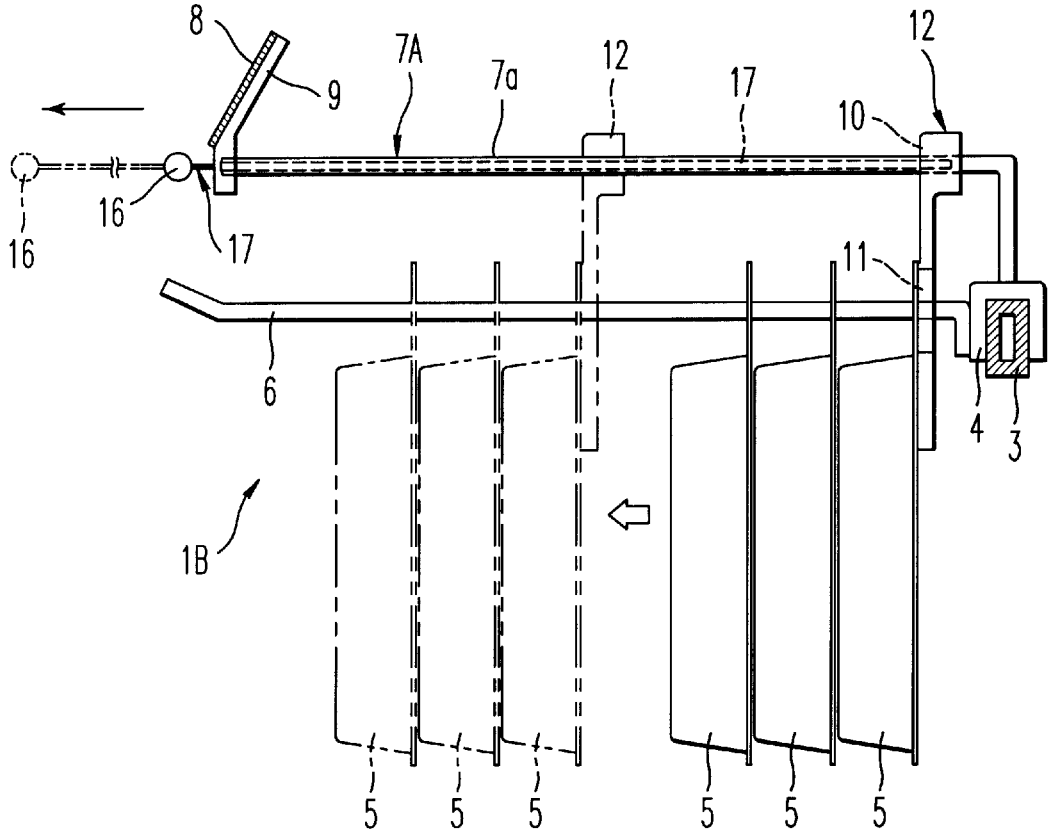
FIG. 9 illustrates a side view of a third embodiment of the present invention in a used state.
Figure 10:
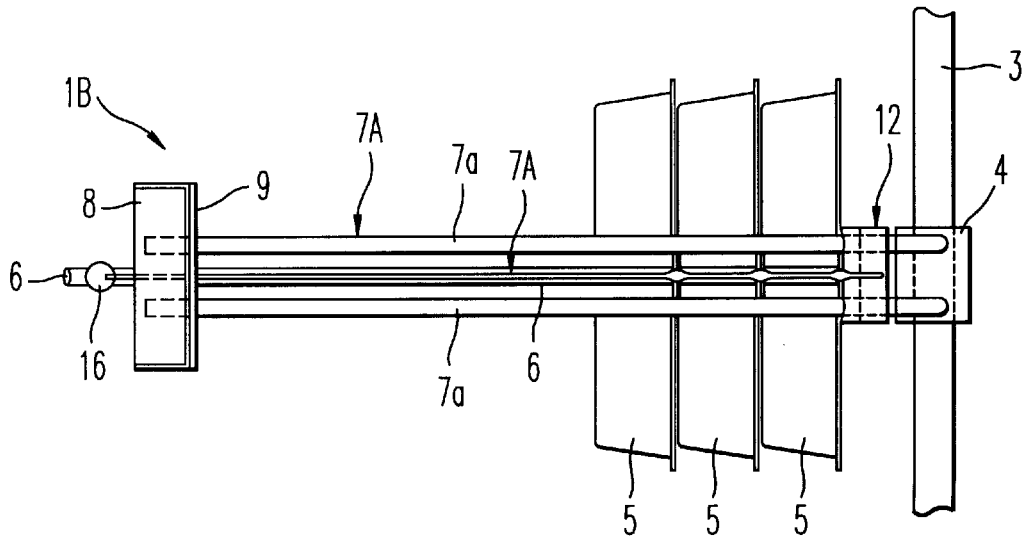
FIG. 10 illustrates a plan view of the third embodiment of the present invention in a used state.

A third embodiment of the present invention in FIGS. 9 and 10 differs from the foregoing second embodiment of the present invention mainly in that a supporting bar 7A composed of two parallelly arranged bar members 7*a*, 7*a* are used, and an article display device 1B thus constructed also has similar meritorious effects to the foregoing second embodiment of the present invention.

Figure 11:
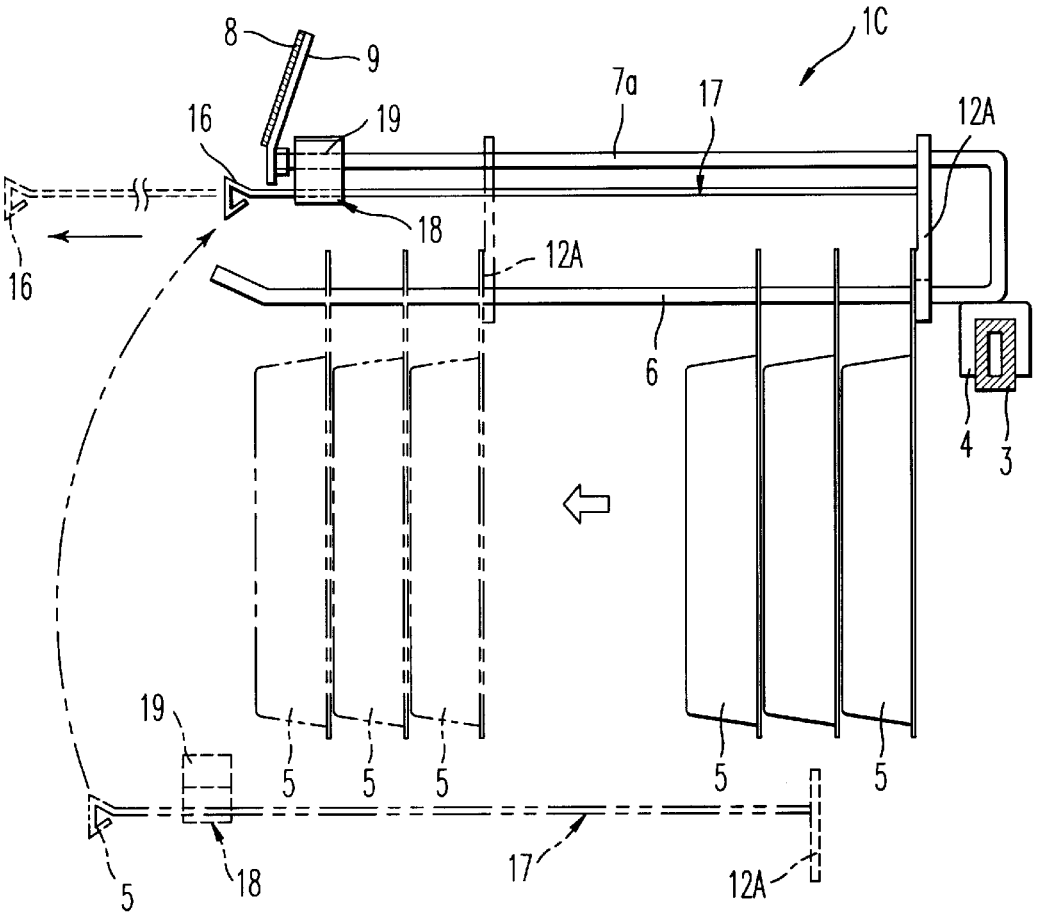
FIG. 11 illustrates a side view of a fourth embodiment of the present invention in a used state.
Figure 12:
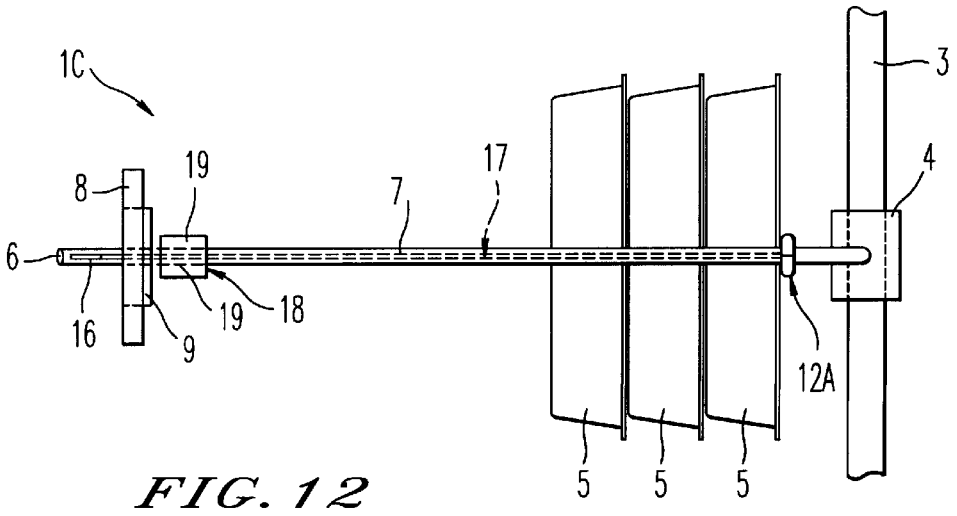
FIG. 12 illustrates a plan view of the fourth embodiment of the present invention in a used state.

A fourth embodiment of the present invention in FIGS. 11 and 12 differs from the foregoing first embodiment mainly in that a wire is used to form a manipulation bar 17 having an urging body 12A formed in a rear end portion, and a sandwiching member 19 is formed for supporting a supporting bar 7, in a sandwiching form, to a supporting member 18 for slidably supporting the manipulation bar 17. An article display device 1C thus constructed also has similar meritorious effects to the foregoing second embodiment of the present invention.

Figure 13:
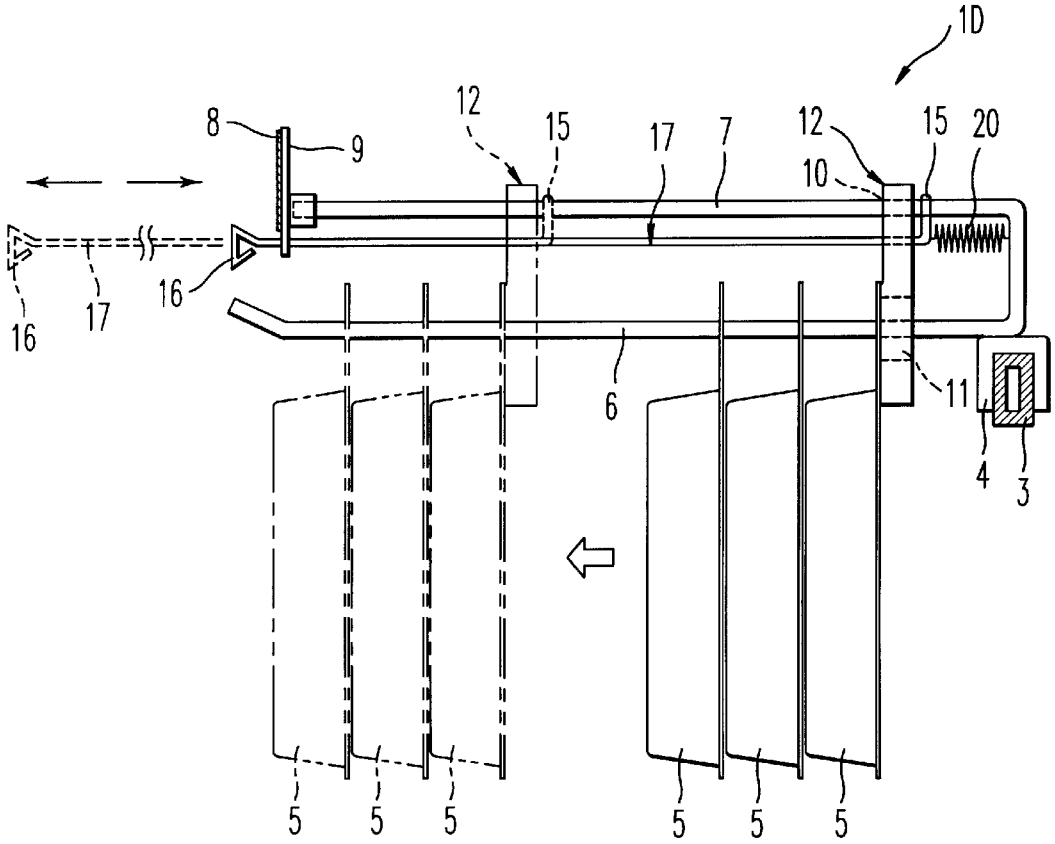
FIG. 13 illustrates a side view of a fifth embodiment of the present invention in a used state.
Figure 14:
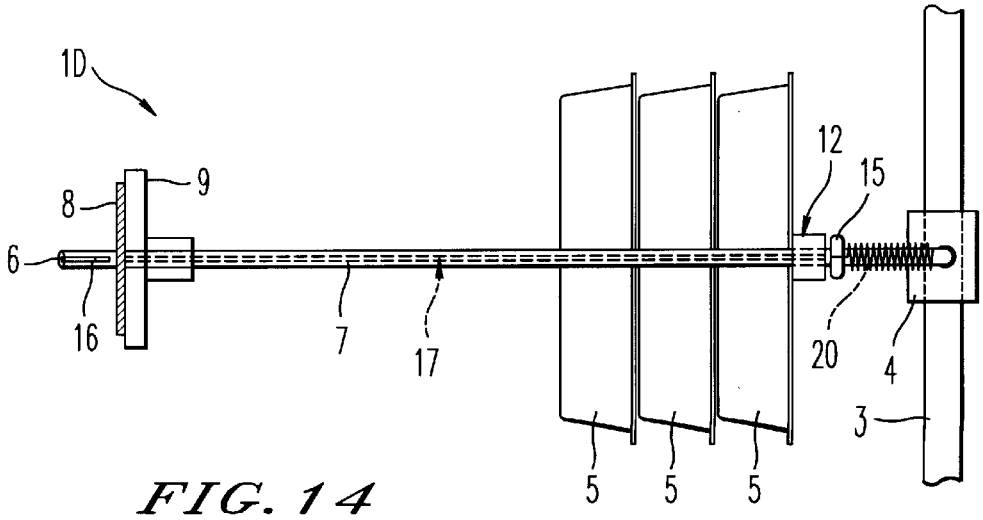
FIG. 14 illustrates a plan view of the fifth embodiment of the present invention in a used state.

A fifth embodiment of the present invention in FIGS. 13 and 14 differs from the foregoing first embodiment of the present invention mainly in that a resilient body 20, a tension spring in this embodiment, is interposed between the rear end of a manipulation bar 17 and the rear end of a supporting bar 7 such that the manipulation bar 17 may be always positioned in a retracted state. An article display device 1D thus constructed also has similar meritorious effects to the foregoing first embodiment of the present invention.

Figure 15:
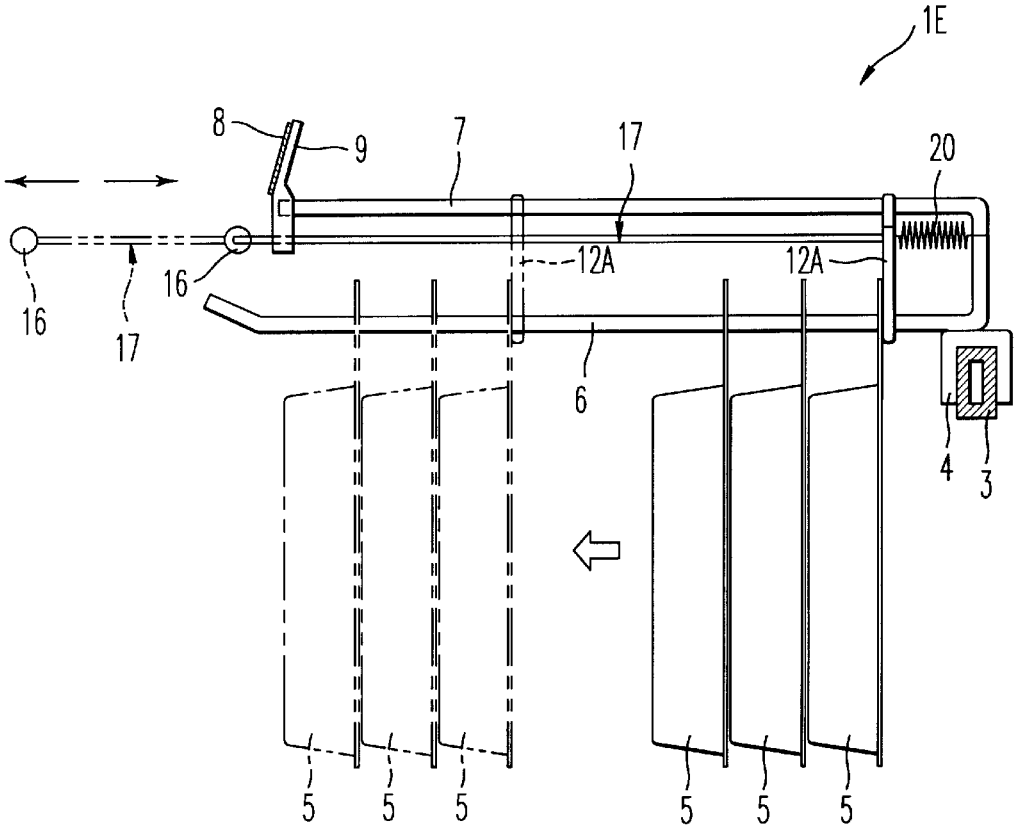
FIG. 15 illustrates a side view of a sixth embodiment of the present invention in a used state.
Figure 16:
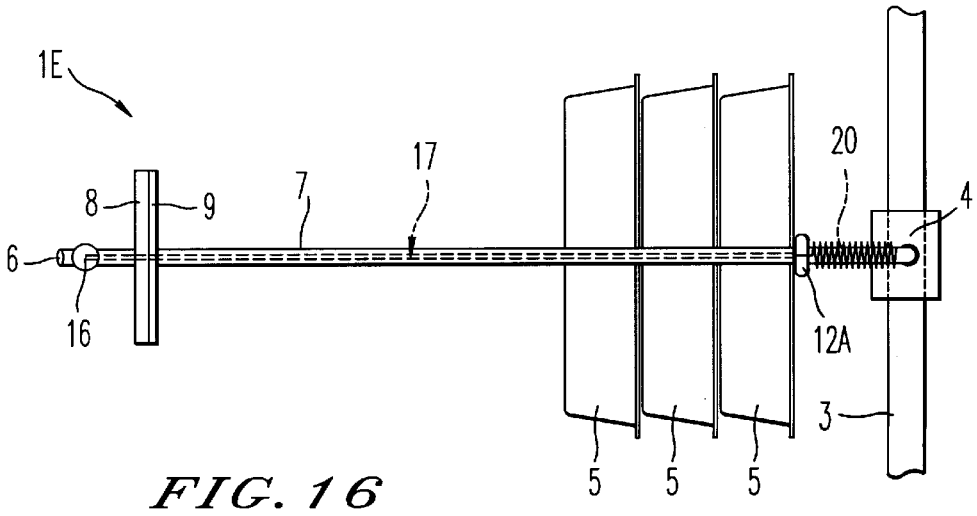
FIG. 16 illustrates a plan view of the sixth embodiment of the present invention in a used state.

A sixth embodiment of the present invention in FIGS. 15 and 16 differs from the foregoing second embodiment mainly in that a manipulation bar 17 having an urging body 12A formed integrally therewith at the rear end may be always positioned in a retracted state with a tension spring 20. An article display device 1E thus constructed also has similar meritorious effects to the foregoing second embodiment of the present invention.

Figure 17:
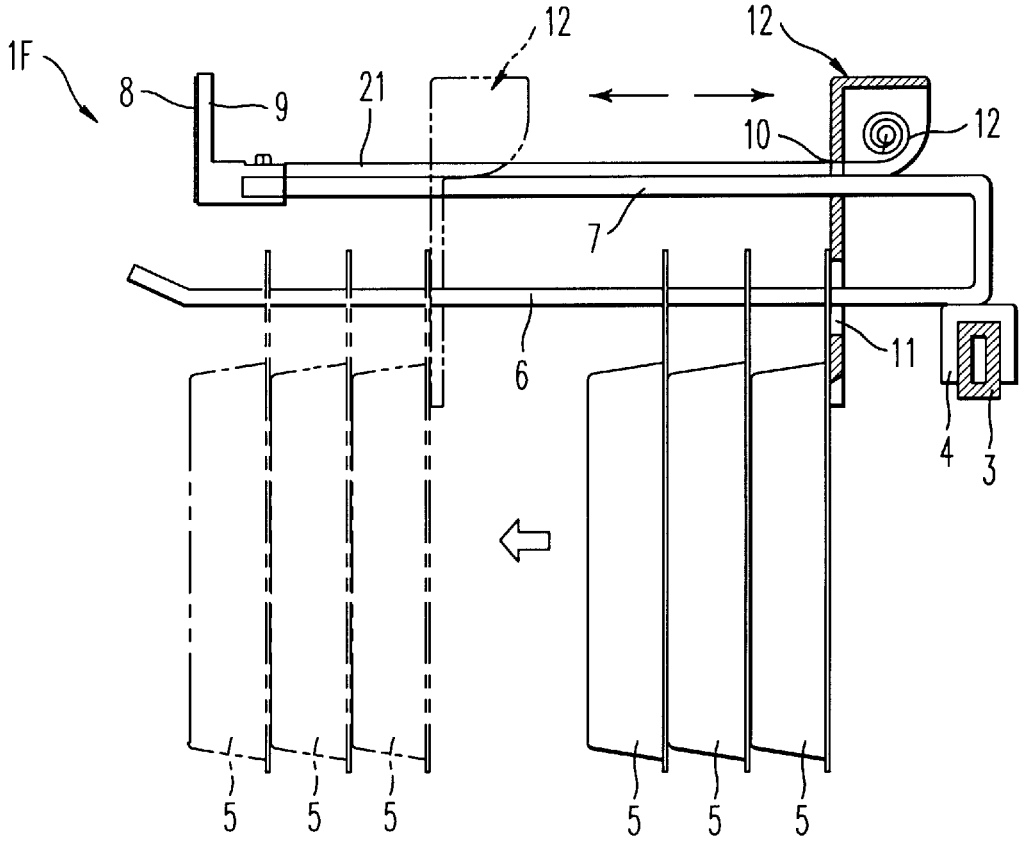
FIG. 17 illustrates a partially cross-sectioned side view of a seventh embodiment of the present invention in a used state.
Figure 18:
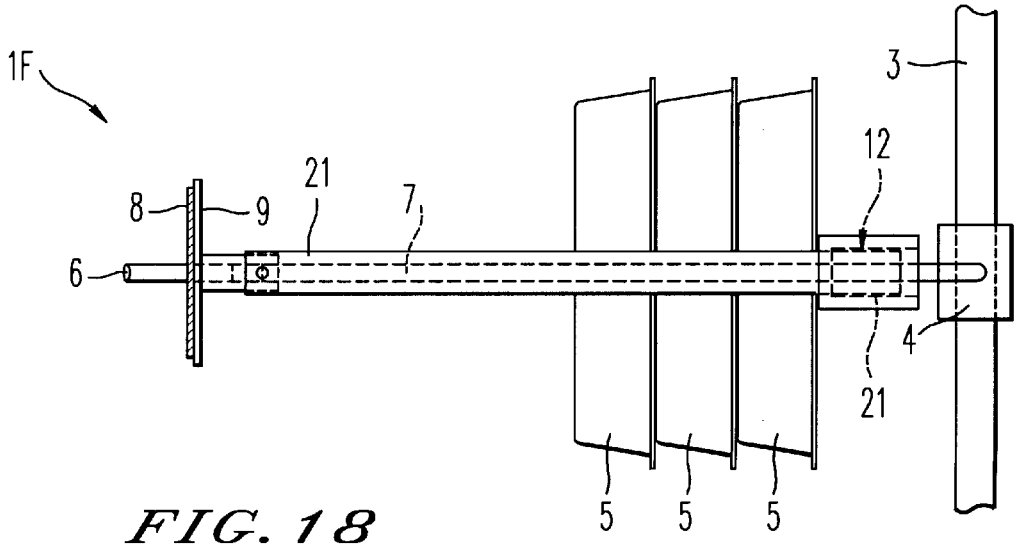
FIG. 18 illustrates a plan view of the seventh embodiment of the present invention in a used state.

A seventh embodiment of the present invention in FIGS. 17 and 18 differs from the foregoing first embodiment of the present invention mainly in that an urging body 12 is automatically slid. In this embodiment, the urging body 12 is provided with a fixed load spring 21 for always moving the urging body 12 forwardly with a predetermined pushing pressure. An article display device 1F thus constructed also has similar meritorious effects to the foregoing first embodiment, and in addition, can automatically urge articles 5 forwardly.

Figure 19:
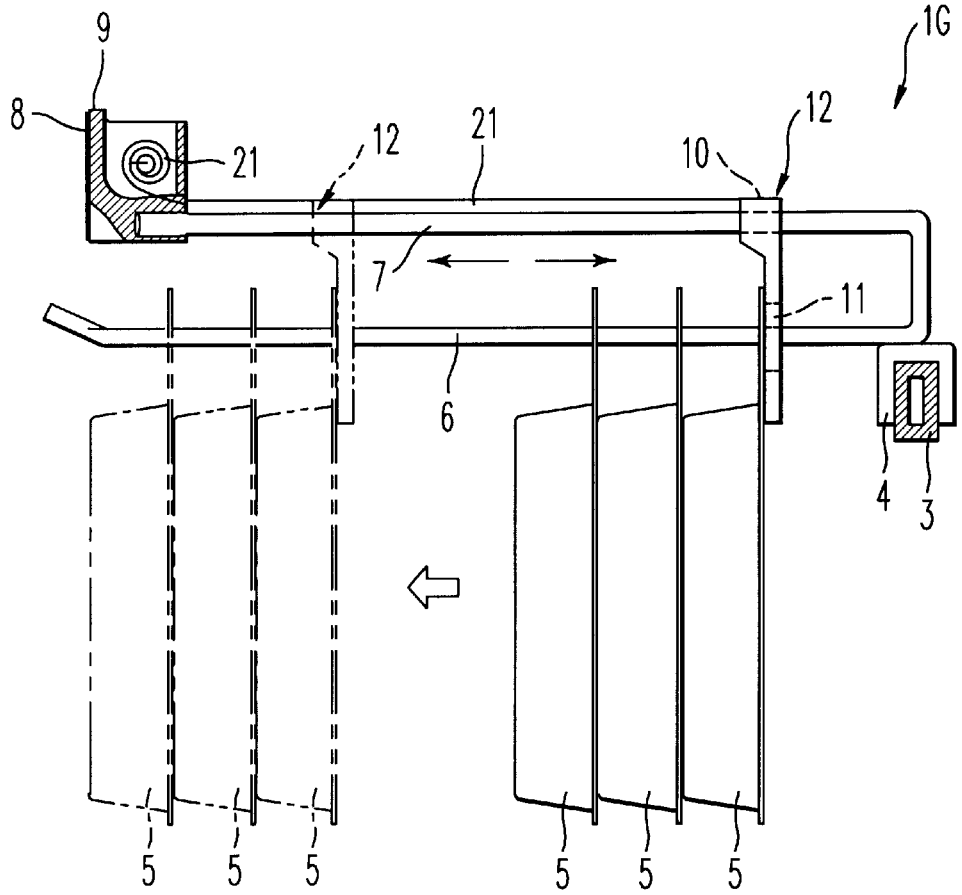
FIG. 19 illustrates a partially cross-sectioned side view of an eighth embodiment of the present invention in a used state.
Figure 20:
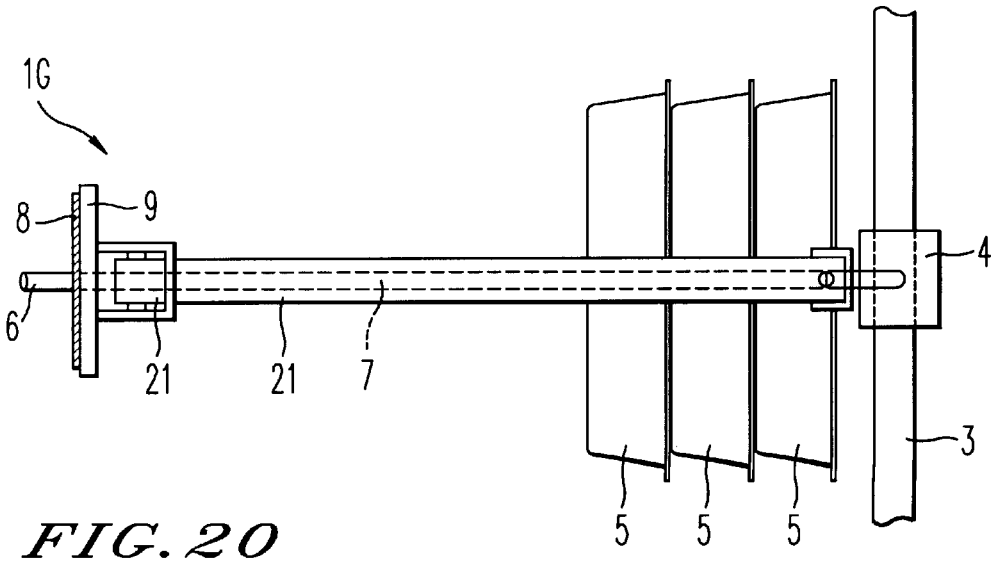
FIG. 20 illustrates a plan view of the eighth embodiment of the present invention in a used state.

An eighth embodiment of the present invention in FIGS. 19 and 20 differs from the foregoing seventh embodiment of the present invention mainly in that a display plate 9 is provided with a fixed load spring 21, and an article display device 1G thus constructed also has similar meritorious effects to the foregoing seventh embodiment of the present invention.

Figure 21:
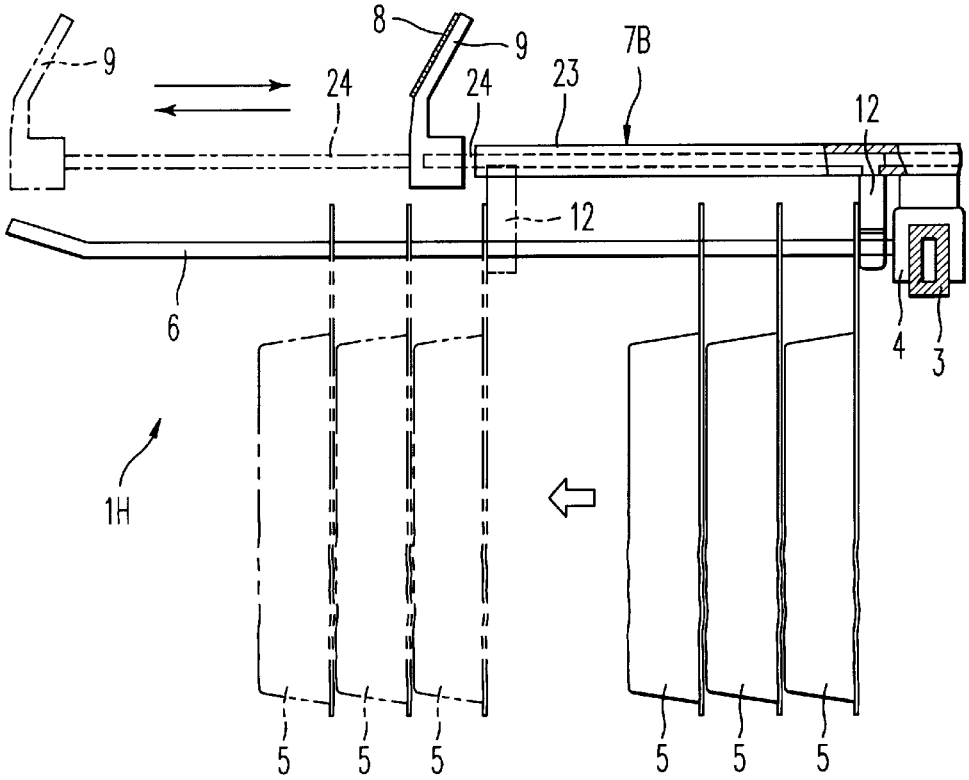
FIG. 21 illustrates a partially cross-sectioned side view of a ninth embodiment of the present invention in a used state.
Figure 22:
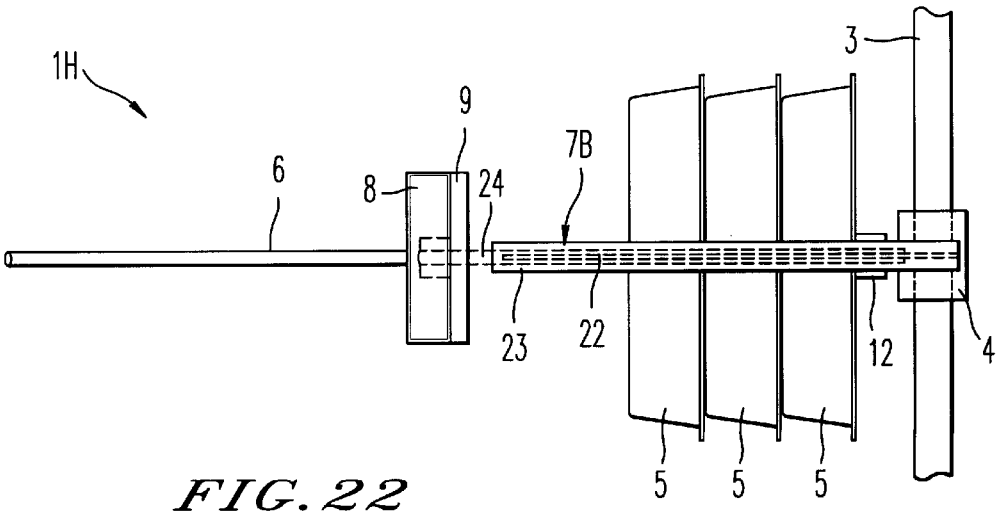
FIG. 22 illustrates a plan view of the ninth embodiment of the present invention in a used state.

A ninth embodiment of the present invention in FIGS. 21 and 22 differs from the foregoing second embodiment of the present invention mainly in that an urging body 12 is attached to a position near the rear end of a movable display plate supporting bar 24, which has a display plate 9 at the front end thereof, slidably attached to a supporting bar 23. In this embodiment, a supporting bar 7B is composed of the cylindrical fixed supporting bar 23 having a guide groove 22 fixed to an engaging piece 4 and the movable display plate supporting bar 24, onto which the display plate 9 is fixedly fitted on a front end portion, slidably attached to the fixed supporting bar 23, and the urging body 12, which moves along the guide groove 22 of the fixed supporting bar 23, is secured to the rear end of the movable display plate supporting bar 24 of the supporting bar 7B. An article display device 1H thus constructed also has similar meritorious effects to the foregoing second embodiment of the present invention.

Figure 23:
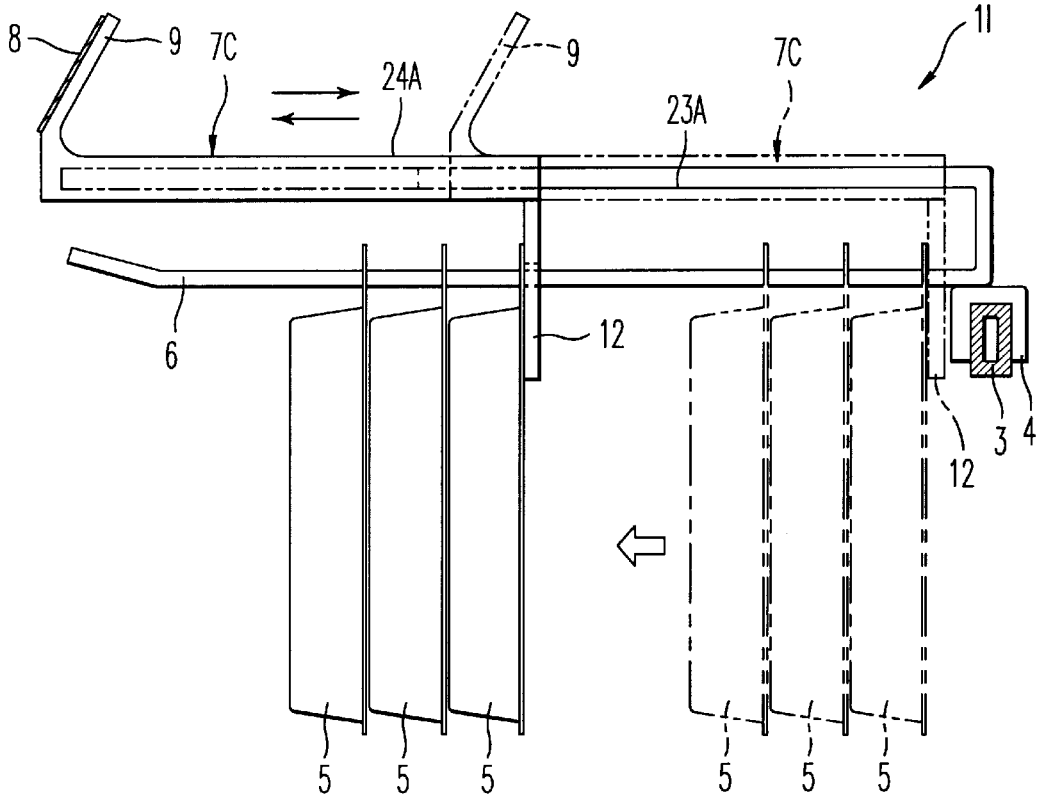
FIG. 23 illustrates a side view of a tenth embodiment of the present invention in a used state.
Figure 24:
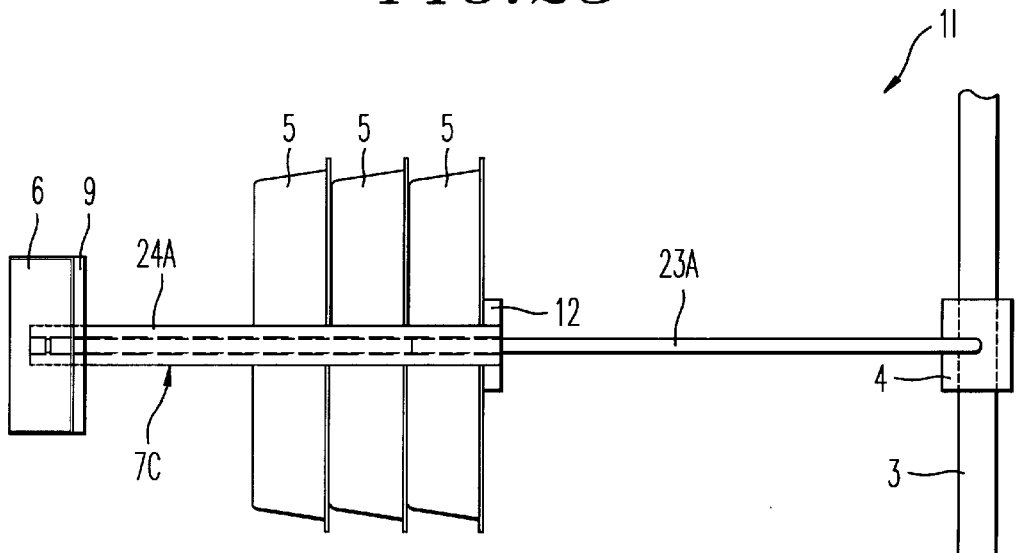
FIG. 24 illustrates a plan view of the tenth embodiment of the present invention in a used state.

A tenth embodiment of the present invention in FIGS. 23 and 24 differs from the foregoing ninth embodiment of the present invention mainly in that the former employs a rod-like fixed supporting bar 23A, and also employs a supporting bar 7C which includes a cylindrical member serving as a movable display plate supporting bar 24A which is slidably attached to the fixed supporting bar 23A. An article display device 1I thus constructed also has similar meritorious effects to the foregoing ninth embodiment of the present invention.

Figure 25:
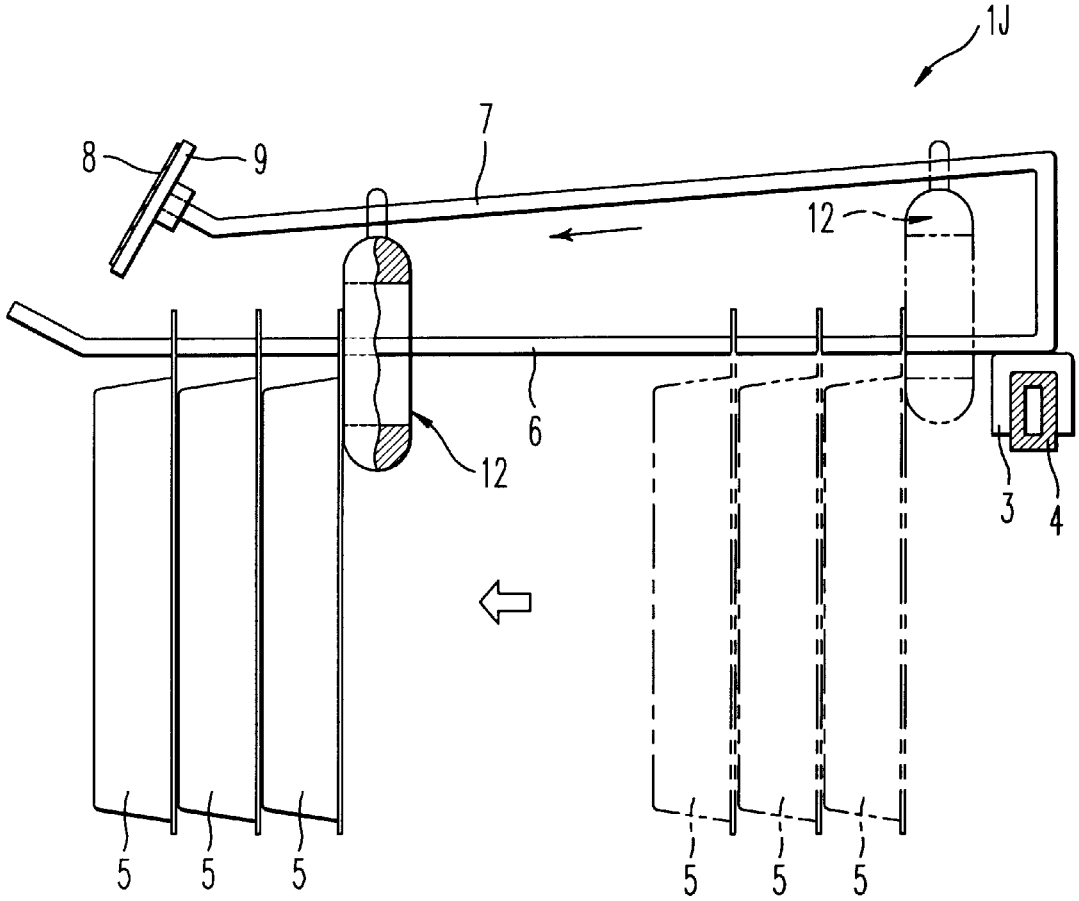
FIG. 25 illustrates a side view of an eleventh embodiment of the present invention in a used state.
Figure 26:
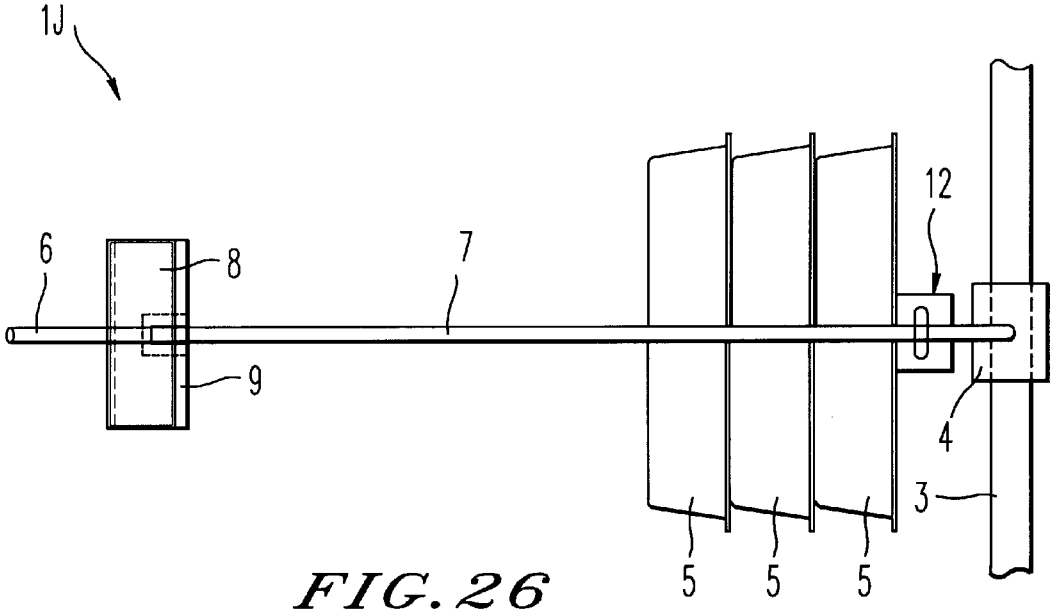
FIG. 26 illustrates a plan view of the eleventh embodiment of the present invention in a used state.

An eleventh embodiment of the present invention in FIGS. 25 and 26 differs from the foregoing first embodiment of the present invention mainly in that a supporting bar 7 is inclined downwardly toward the front end such that an urging body 12 always slides to the front. An article display device 1J thus constructed also has similar meritorious effects to the foregoing first embodiment of the present invention.

Figure 27:
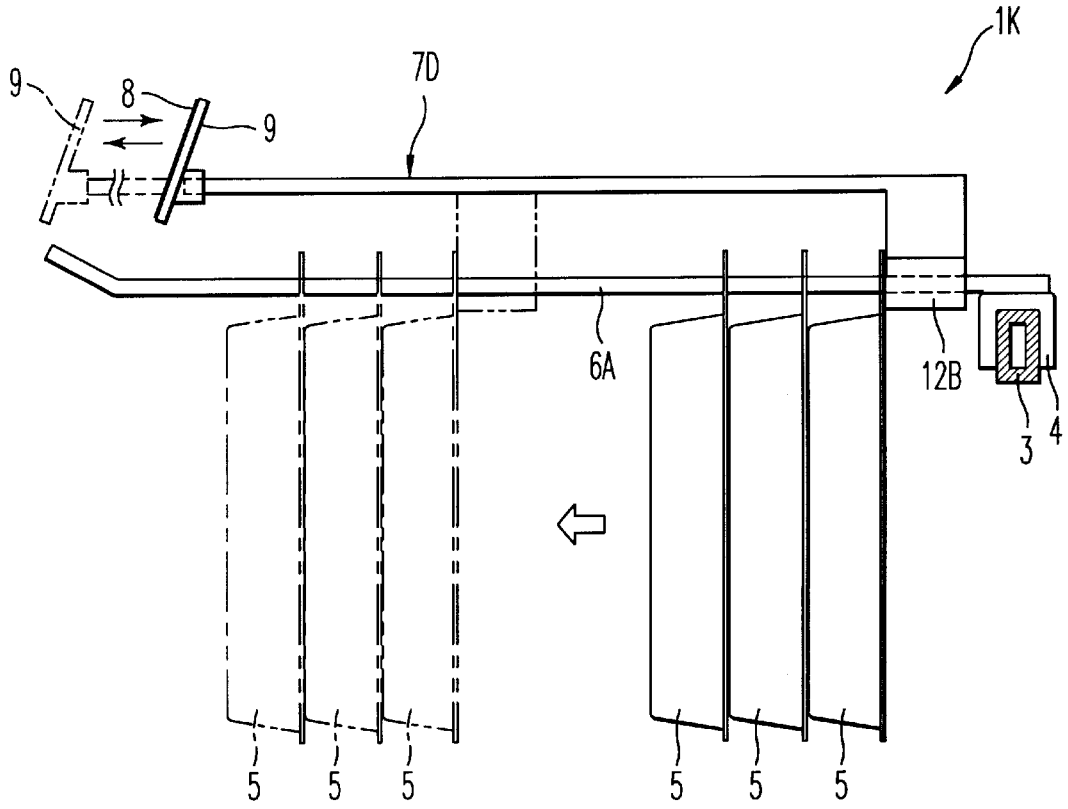
FIG. 27 illustrates a partial side view of a twelfth embodiment of the present invention in a used state.
Figure 28:
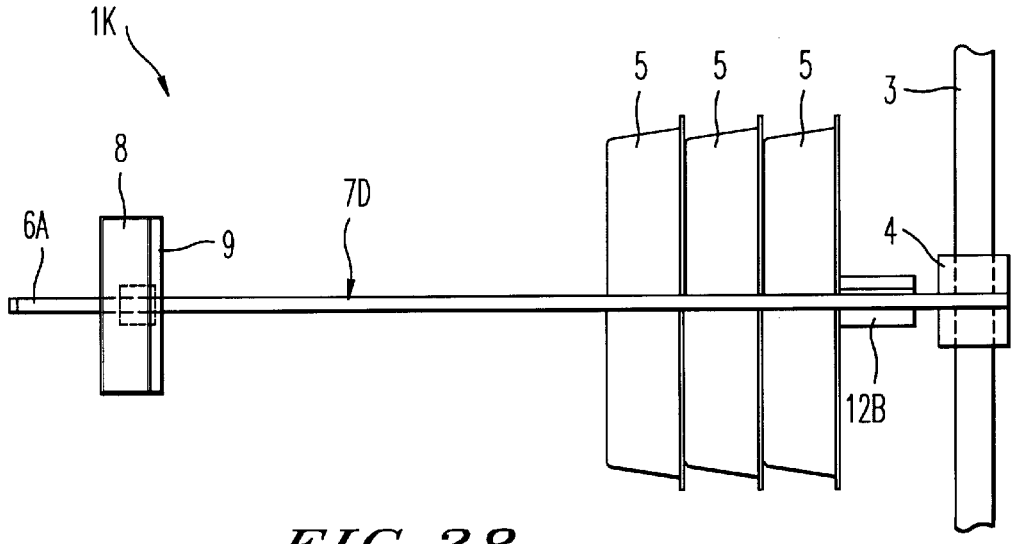
FIG. 28 illustrates a plan view of the twelfth embodiment of the present invention in a used state.

A twelfth embodiment of the present invention in FIGS. 27 and 28 differs from the foregoing first embodiment of the present invention mainly in that an article display bar 6A having a non-circular cross-section, or a rectangular cross-section in this embodiment, and a supporting bar 7D having the rear end secured to an urging body 12B non-rotatably but slidably attached to the article display bar 6A are employed. An article display device 1K thus constructed also has similar meritorious effects to the foregoing first embodiment of the present invention, and can provide a simpler structure.

In this embodiment of the present invention, since the urging body 12B is only required to be non-rotatable about but slidable along the article display bar 6A, the article display bar 6A may be non-circular in cross-section and have a shaft which is elliptic, polygonal, or non-circular in cross section and formed with a guide piece, a guide groove, or the like.

Figure 29:
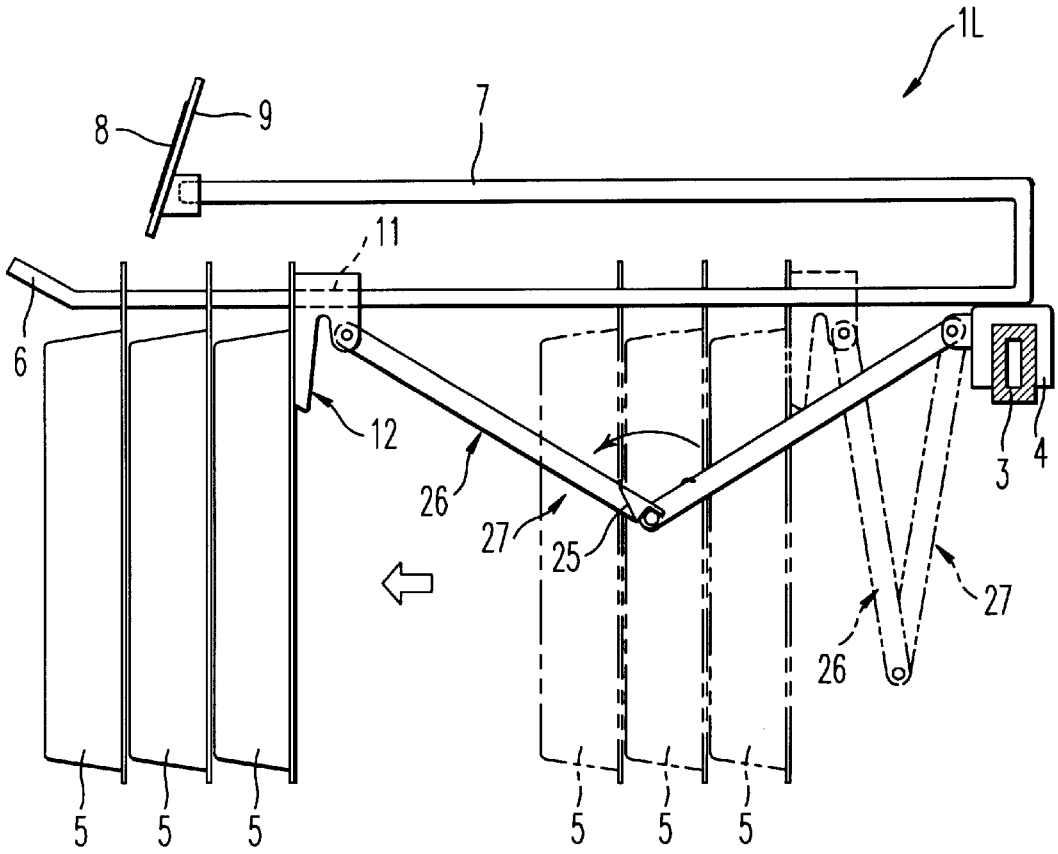
FIG. 29 illustrates a side view of a thirteenth embodiment of the present invention in a used state.
Figure 30:
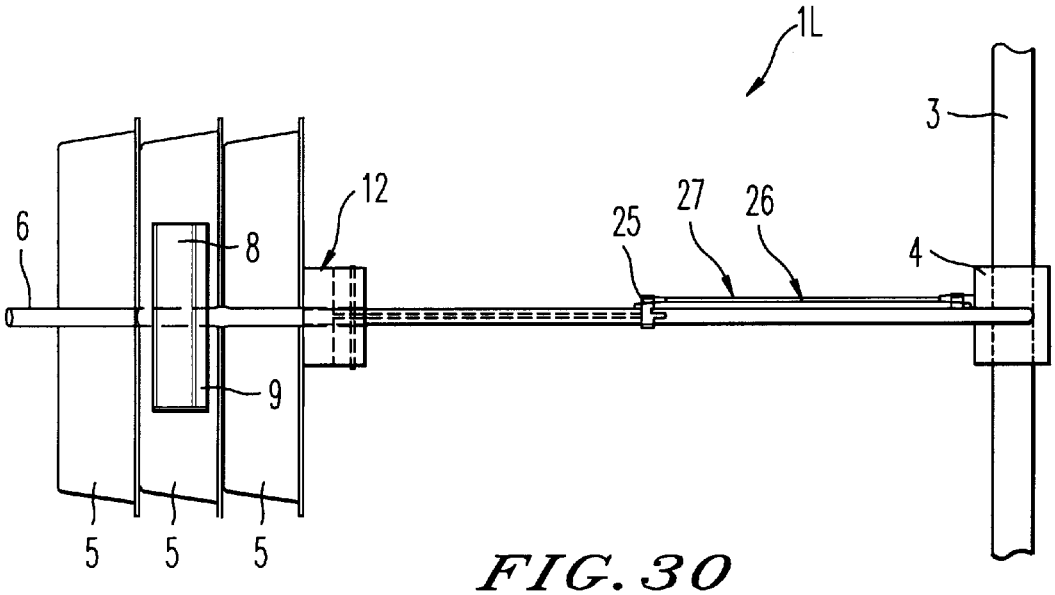
FIG. 30 illustrates a plan view of the thirteenth embodiment of the present invention in a used state.

A thirteenth embodiment of the present invention in FIGS. 29 and 30 differs from the foregoing first embodiment of the present invention mainly in that a slidable urging body 12 is attached to an article display bar 6, and a pressure applying mechanism 27 using a link 26 for always pushing the urging body 12 to the front with a spring 25 is attached to the urging body 12 and an engaging piece 4. An article display device 1L thus constructed also has similar meritorious effects to the foregoing first embodiment of the present invention, and in addition, can always push articles 5 to the front.

Figure 31:
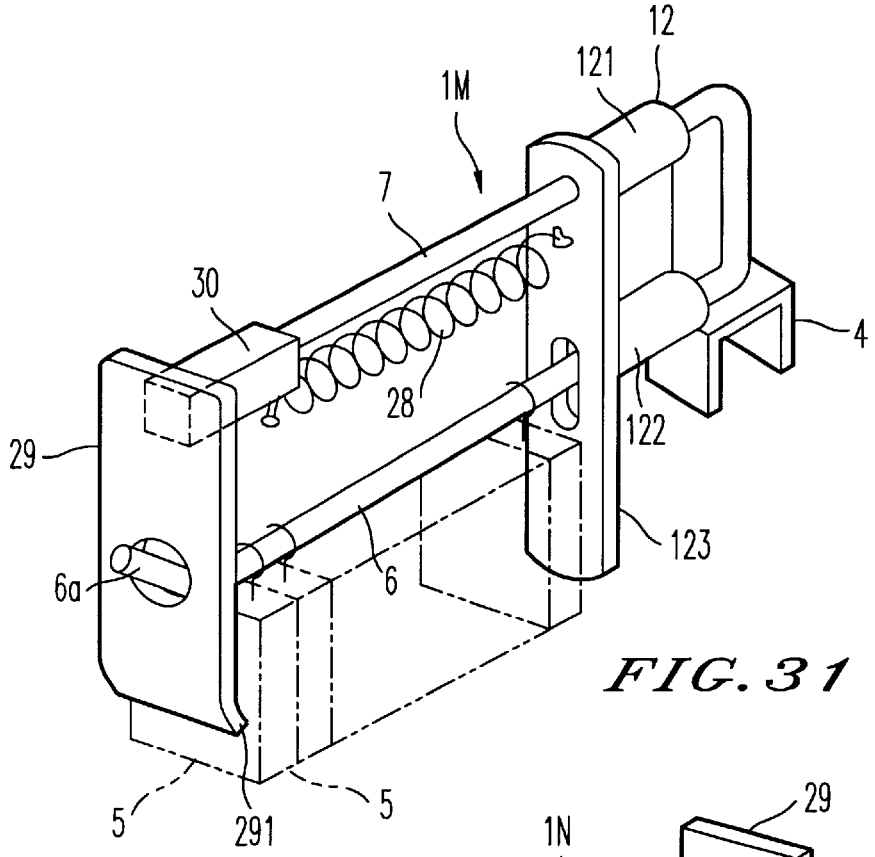
FIG. 31 illustrates a perspective view of a fourteenth embodiment of the present invention in a used state.

A fourteenth embodiment of the present invention in FIG. 31 differs from the foregoing first embodiment of the present invention mainly in that an urging body 12 automatically pushes articles 5 supported by an article display bar 6 with a tension force of a spring coil 28, and an article arrangement correcting member 29 is rotatably (omitted in the figures) disposed at the front end of a supporting bar 7 through a supporting block 30 for also preventing articles from dropping. The urging body 12 comprises guiding portions 121, 122 slidable on the supporting bar 7 and the article display bar 6, and is automatically pushed to the front by the action of the spring coil 28 having one end fixed in an upper portion of a pushing plate 123. The article arrangement correcting member 29 abuts to a portion positioned below an engaging position of an article 5 supported by the article display bar 6 and positioned at the forefront with the article display bar 6 (above the position of the center of gravity of the article) to correct the articles 5 supported by the article display bar 6 to be in a stationary state or in a substantially perpendicularly arranged posture. The article arrangement correcting member 29 is made of a transparent material such as acrylic resin or the like and molded into a vertically long rectangle. An article display device 1M thus constructed also has similar meritorious effects to the foregoing first embodiment of the present invention. Also, a combination of the urging body 12 and the article arrangement correcting member 29 provides either of heavy and light articles with more attractive appearance. Further, by forming an abutting end 291 at the lower end of the article arrangement correcting member 29 by bending the same toward the article 5, the article 5 is in contact with a smaller area of the article arrangement correcting member 29 so that damages to the article 5 due to friction with the article arrangement correcting member 29 can be reduced. When an article 5 is removed from the article display device 1M, the article 5 positioned at the head of the article display bar 6 is held by fingers and drawn out from the front end of the article display bar 6. Since this causes the article arrangement correcting member 29 to rotate (omitted in the figure), the extraction of an article can be facilitated. In this event, after the article 5 is extracted from the article display bar 6, the article arrangement correcting member 29 immediately returns to the original position, and the articles 5 supported by the article display bar 6 are arranged in a perpendicularly supported state by the forwardly urging action of the urging body 12.

Figure 32:
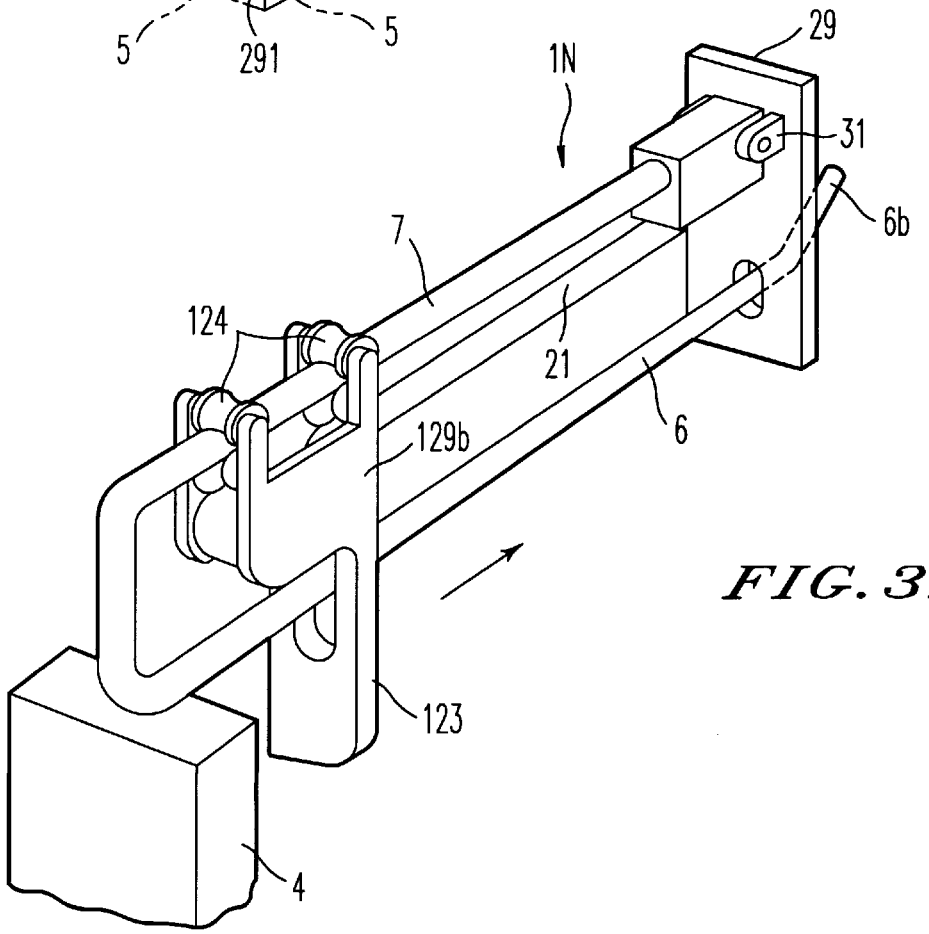
FIG. 32 illustrates a perspective view of a fifteenth embodiment of the present invention in a used state.

A fifteenth embodiment of the present invention in FIG. 32 differs from the foregoing fourteenth embodiment of the present invention in that an urging body 12 is guided and slid along a supporting bar 7 by a guide roller 124. An article display device 1N thus constructed also has similar meritorious effects to the foregoing fourteenth embodiment of the present invention.

Figure 33:
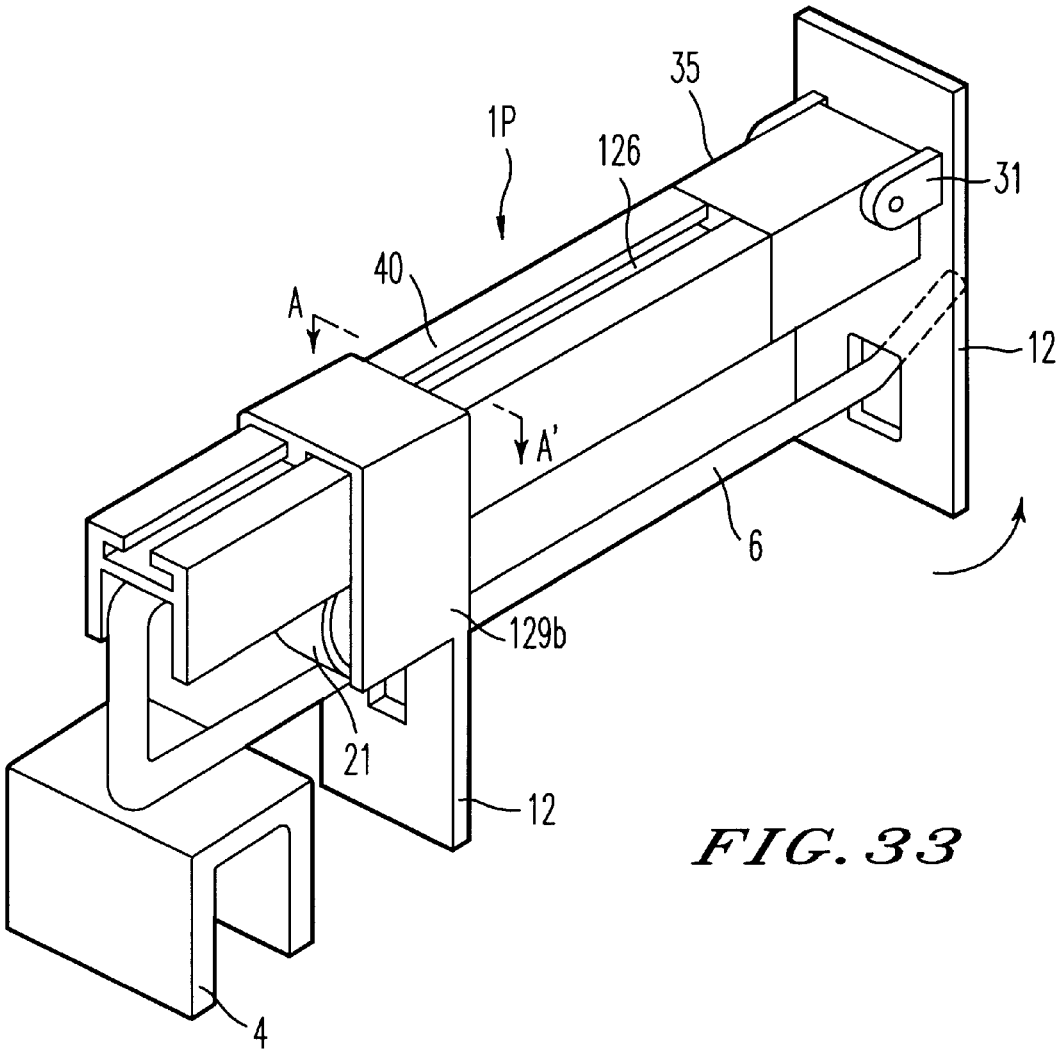
FIG. 33 illustrates a perspective view of a sixteenth embodiment of the present invention in a used state.
Figure 34:
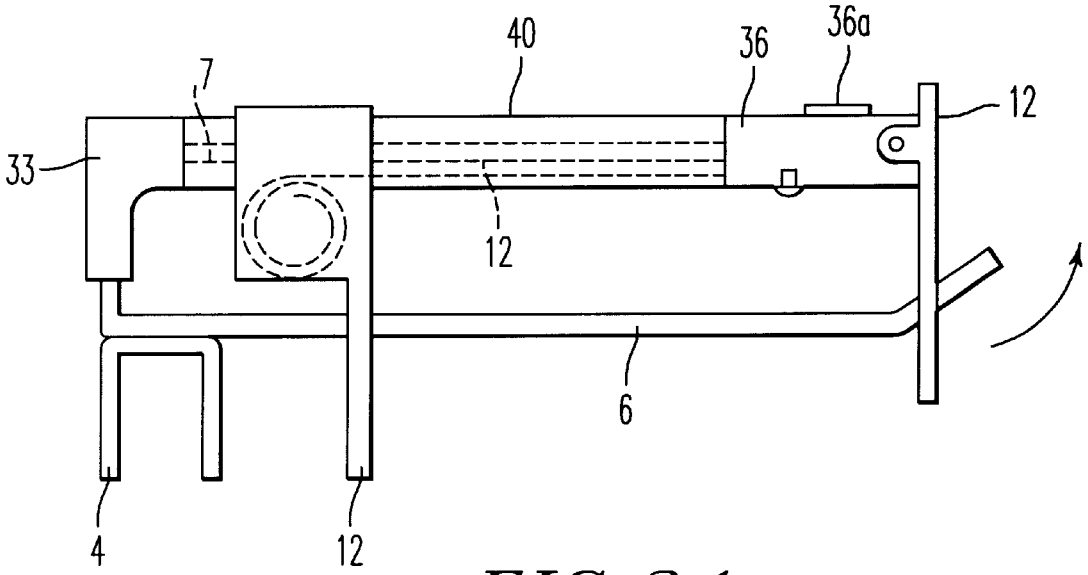
FIG. 34 illustrates a side view of FIG. 33 in a used state.
Figure 35:
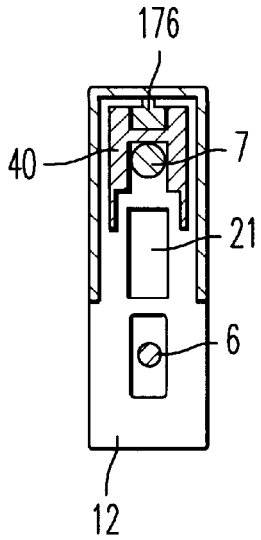
FIG. 35 illustrates a cross-sectional view taken along a line A—A in FIG. 33.

A sixteenth embodiment of the present invention in FIGS. 33–35 differs from the foregoing fifteenth embodiment of the present invention in that a cover case 40 having a guide groove 126, along which an urging body 12 slides, is formed to cover a supporting bar 7. An article display device 1P thus constructed, in addition to having similar meritorious effects to the foregoing fourteenth embodiment of the present invention, serves as an attractive display device since the cover case 40 covers a spring coil, a leaf spring, and so on.

Figure 36:
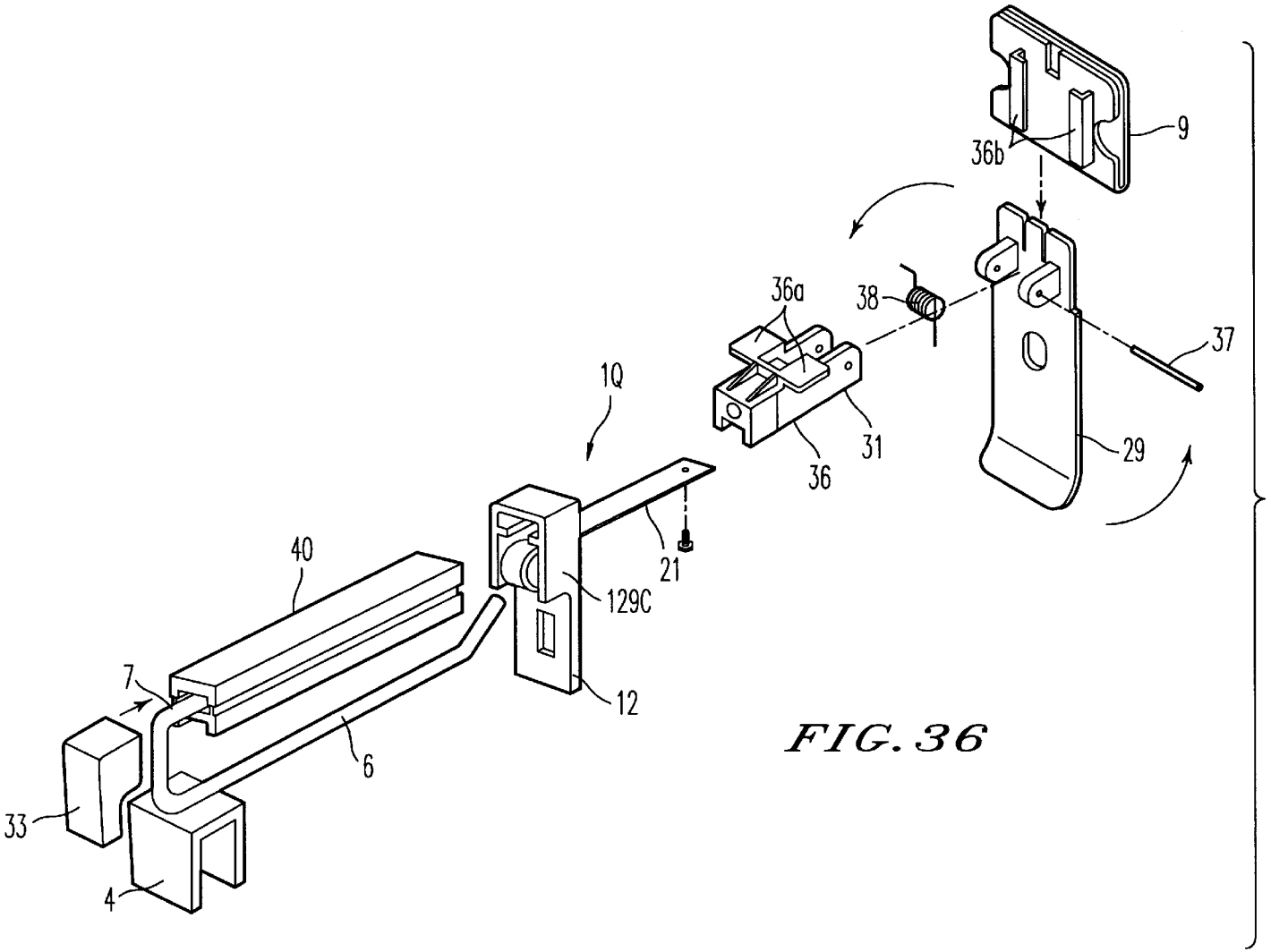
FIG. 36 illustrates an exploded view illustrating the structure of a seventeenth embodiment of the present invention.
Figure 37:
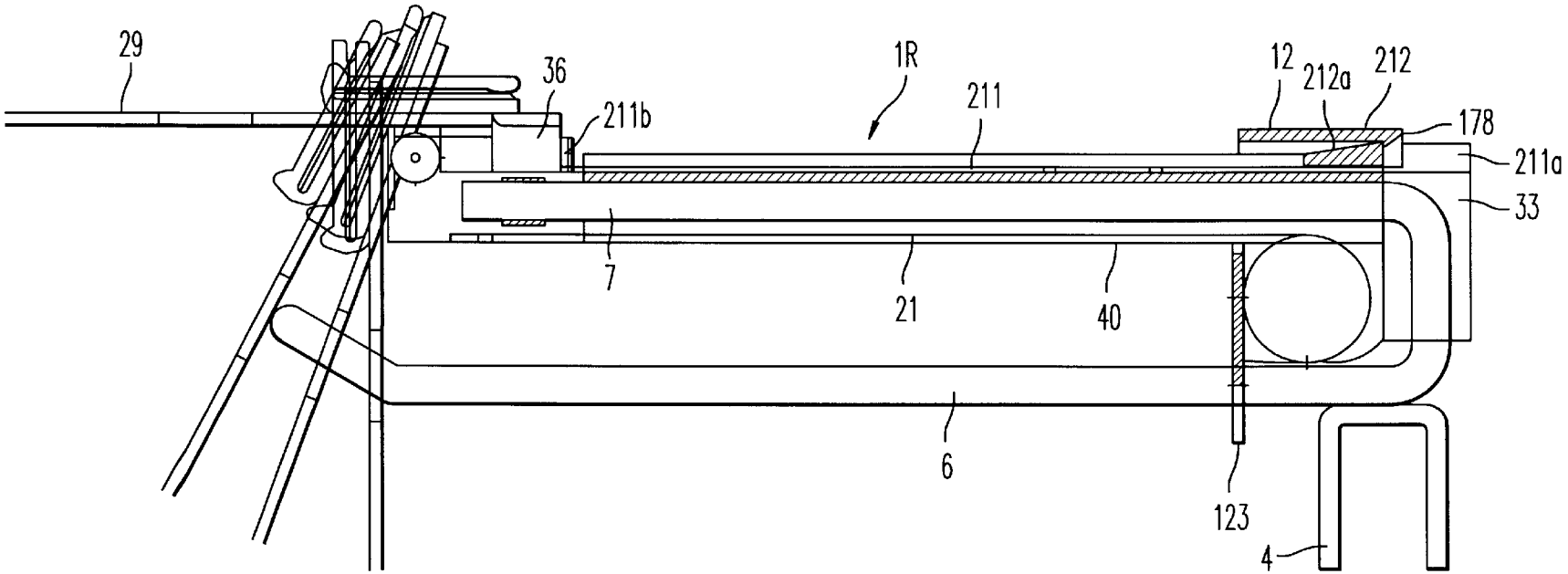
FIGS. 37 and 38 illustrate partially cross-sectioned front views of an eighteenth embodiment of the present invention in a used state.
Figure 38:
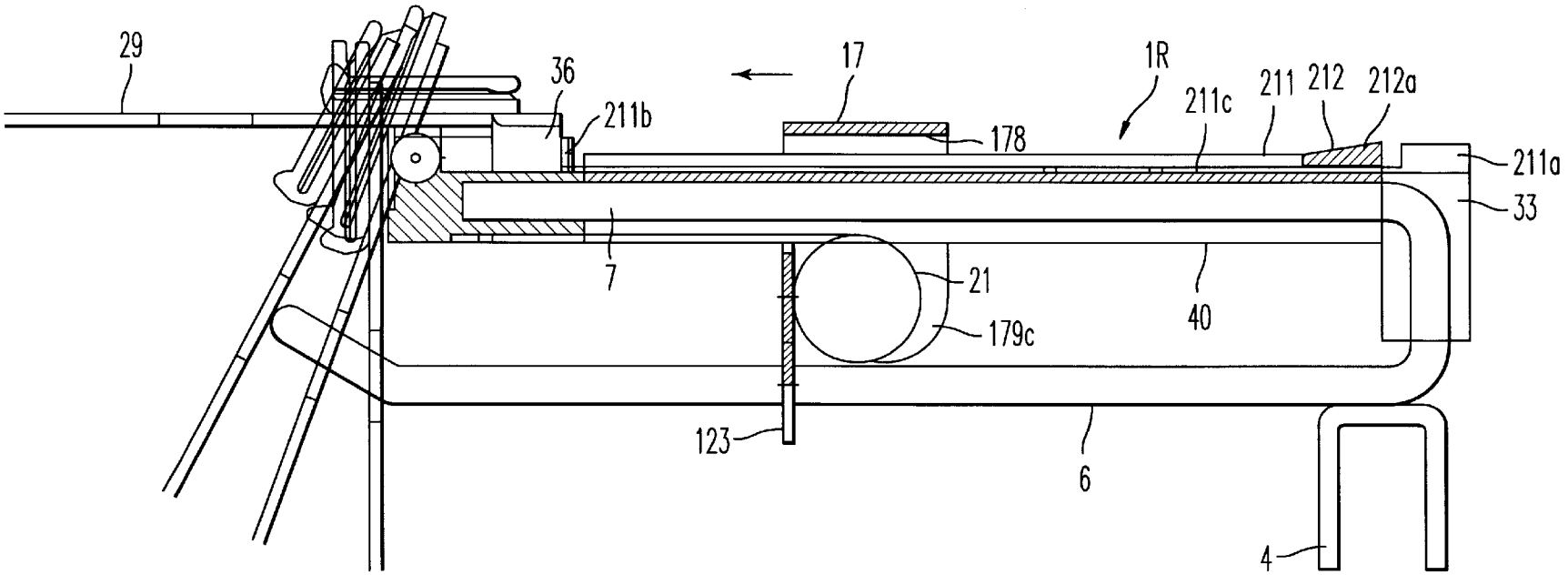
Figure 39:
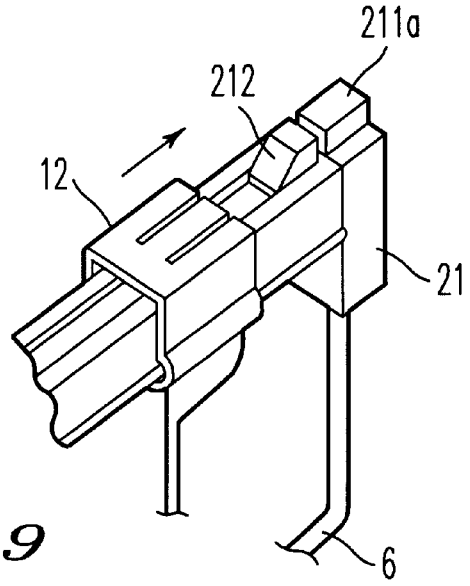
FIG. 39 illustrates a partially cut-away perspective view showing the eighteenth embodiment of the present invention.
Figure 40A:
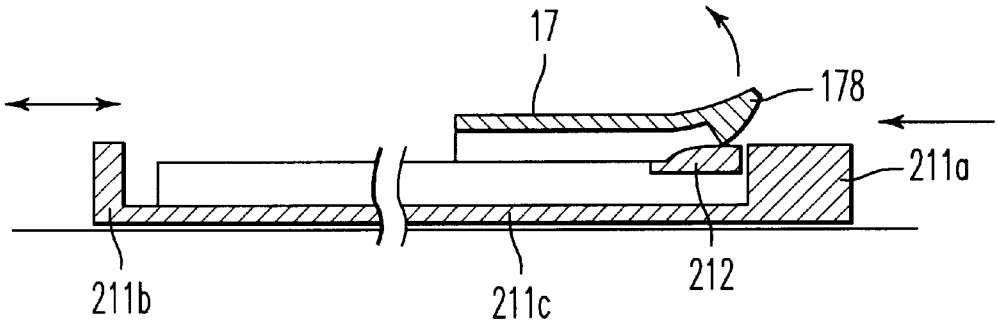
FIG. 40 illustrates a cross-sectional view for explaining a stopper means in the eighteenth embodiment of the present invention. In the drawings, reference numeral 1 designates an article display device of the present invention; 3 a bar member; 4 an engaging piece; 6 an article display bar; 7 a supporting bar; 9 a display plate; and 12 an urging body, respectively.
Figure 40B:
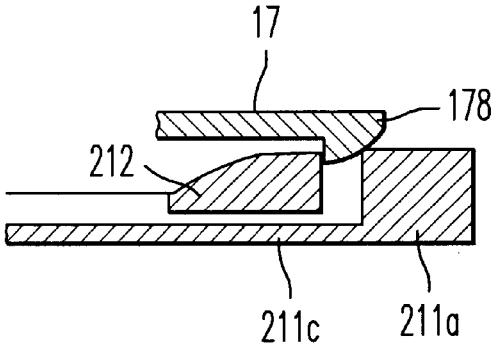

A seventeenth embodiment of the present invention in FIG. 36 differs from the sixteenth embodiment in a rotation supporting mechanism for the article arrangement correcting member 29. More specifically, in place of the stopper member and a spring (omitted in the figure) in FIG. 33, a pair of engaging portions 36*a* is formed integrally with a supporting block 36 constituting a rotation supporting mechanism 31 substantially in a central portion of the top surface of the supporting block 36, and the supporting block 36 is attached to the article arrangement correcting member 29 through a torsion spring 38. An article display device 1Q thus constructed also has similar meritorious effects to the foregoing fourteenth embodiment of the present invention. Moreover, in FIG. 36, when articles 5 are supplemented to or fully extracted from the article display device 1Q, the article arrangement correcting member 29 is rotated upwardly and slid toward the supporting block 36, causing the engaging portions 36*a* of the supporting block 36 to engage with an engaging portion 36*b* of a display plate 9, so that the article arrangement correcting member 29 is held in a horizontal state. For this reason, the structure of the rotation supporting mechanism 31 can be made simpler, so that a reduced cost can be attained for the article display device. In addition, the supplement and extraction of articles are facilitated.

An eighteenth embodiment of the present invention in FIGS. 37–40 differs from the seventeenth embodiment in that a means for stopping or releasing the stoppage of an urging body 12 in the rear is provided. More specifically, a stopping means 212 and a stoppage releasing means 211 are attached on the top of a cover case 40 in FIG. 37. The stoppage is achieved by engaging a protrusive stopper 212*a* fixed to the cover case 40 with a stopper protrusion 178 positioned in a rear portion of the urging body 12.

The stoppage releasing means 211, which is composed of a stoppage releasing protrusion 211*a*, a stoppage releasing lever 211*b* and a link 211*c* for linking them, is attached on a supporting bar for movement in the longitudinal direction. For releasing a stopped state of the urging body 12 in a state of FIG. 40(*b*), the stoppage releasing lever 211*b* may be held by fingers at the front end thereof and pulled to the front. Specifically, this causes the stoppage releasing protrusion 211*a* to push up the stopper protrusion 178 upwardly to release the stopped state (FIG. 40(*a*)).

An article display device 1R thus constructed, in addition to having similar meritorious effects to the foregoing seventeenth embodiment of the present invention, provides a higher operability since the urging body 12 is not interfered when articles are displayed or removed using the article display device 1.

While the foregoing respective embodiments of the present invention have been described in connection with the engaging piece 4 fixed to the article display bar 6 or 6A by welding or the like, the present invention is not limited to this, but may employ integrally formed engaging piece 4 and article display bar 6 or 6A.

Also, while the supporting bar 7 having the display plate 9 attached at the front end thereof has been described, the present invention is not limited to this, and the supporting bar 7 may be used without attaching the display plate 9 at the front end thereof.

What is claimed is:

1. An article display device configured to be attached to an article display rack having a bar member, comprising:

an engaging piece configured to be attached to the bar member of the article display rack;

an article display bar on which at least one article may be supported and which has a front end and a rear end which is connected to the engaging piece;

a supporting bar extending along and positioned above the article display bar, the supporting bar being connected to one of the engaging piece and the rear end of the article display bar;

an urging body which is slidably supported by the supporting bar, whereby forward movement of the urging body will cause the at least one article supported by the article display bar to be moved along the article display bar toward the front end of the article display bar;

a manipulation bar having a rear portion attached to the urging body and extending along the supporting bar; and a resilient body, connected to the manipulation bar, configured and arranged to urge the manipulation bar toward the rear end of the article display bar.

* * * * *